US010180636B2

(12) United States Patent
Nakane

(10) Patent No.: US 10,180,636 B2
(45) Date of Patent: Jan. 15, 2019

(54) CHARGER AND IMAGE FORMING APPARATUS

(71) Applicant: Konica Minolta, Inc., Chiyoda-ku, Tokyo (JP)

(72) Inventor: Yoshiki Nakane, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/914,671

(22) Filed: Mar. 7, 2018

(65) Prior Publication Data

US 2018/0284635 A1 Oct. 4, 2018

(30) Foreign Application Priority Data

Mar. 29, 2017 (JP) ..... 2017-065236

(51) Int. Cl.
*G03G 15/02* (2006.01)
*G03G 15/16* (2006.01)
*G03G 15/01* (2006.01)

(52) U.S. Cl.
CPC ..... *G03G 15/0233* (2013.01); *G03G 15/01* (2013.01); *G03G 15/16* (2013.01)

(58) Field of Classification Search
CPC ..... G03G 15/0233; G03G 15/16; G03G 15/01
See application file for complete search history.

(56) References Cited

U.S. PATENT DOCUMENTS 5,597,652 A * 1/1997 Utsunomiya ..... G03G 15/0233 428/340
5,790,927 A * 8/1998 Ando ..... G03G 15/0233 399/174
2003/0095812 A1 5/2003 Nagamori et al.
2006/0188294 A1* 8/2006 Onishi ..... G03G 15/0233 399/176
2006/0280518 A1* 12/2006 Kamoshida ..... G03G 15/0233 399/100
2008/0038016 A1* 2/2008 Tokuwaki ..... G03G 15/0216 399/168

(Continued)

FOREIGN PATENT DOCUMENTS

JP H10-186800 A 7/1998
JP 2002-049217 A 2/2002
JP 2003-156920 A 5/2003

*Primary Examiner* — Francis C Gray
(74) *Attorney, Agent, or Firm* — Buchanan Ingersoll & Rooney PC

(57) ABSTRACT

A charger includes a charging roller and a support portion which rotationally supports the charging roller. The charging roller includes a first region which is opposed to the support portion and a second region which is not opposed to the support portion. The charging roller includes a conductive shaft, an end part cover portion which is in contact with and covers the conductive shaft in a portion corresponding to the first region and is in slide contact with the support portion, and a high-resistance coating which is in contact with and covers the conductive shaft in a portion corresponding to the second region and abuts on a charged object. An inner end portion of the end part cover portion is covered with the high-resistance coating, and a thickness of the high-resistance coating is equal to or greater than a thickness of the end part cover portion.

16 Claims, 11 Drawing Sheets

(56) References Cited

U.S. PATENT DOCUMENTS

| | | | | |
|---|---|---|---|---|
| 2010/0215400 | A1* | 8/2010 | Nakamura | G03G 15/0233 399/111 |
| 2012/0155922 | A1* | 6/2012 | Miyake | G03G 15/0233 399/176 |
| 2017/0371263 | A1* | 12/2017 | Hayashida | G03G 15/0808 |
| 2017/0371264 | A1* | 12/2017 | Nonaka | G03G 15/0233 |

* cited by examiner

FIG.13

| SAMPLE NUMBER | 1 | 2 | 3 | 4 | 5 | 6 |
|---|---|---|---|---|---|---|
| COEFFICIENT OF FRICTION AGAINST NONWOVEN FABRIC | 0.19 | 0.24 | 0.29 | 0.33 | 0.37 | 0.43 |
| RESULT OF EVALUATION | EXCELLENT | EXCELLENT | EXCELLENT | GOOD | POOR | POOR |

CHARGER AND IMAGE FORMING APPARATUS

The entire disclosure of Japanese Patent Application No. 2017-065236 filed on Mar. 29, 2017 is incorporated herein by reference in its entirety.

BACKGROUND

Technological Field

The present disclosure relates to a contact type charger including a charging roller and an image forming apparatus including the same.

Description of the Related Art

Chargers of various forms have conventionally been known. For such reasons as being free from ozone, reduction in size of an apparatus, and lowering in charging current, a contact type charger including a charging roller has widely been used. The charger charges a charged object by bringing a charging roller into contact with the charged object, and it is particularly suitably used for charging of a photoconductor as a charged object provided in an image forming apparatus.

In a charger of this type, in many cases, a charging roller is rotatably constructed by rotationally supporting a pair of axial end portions thereof with a pair of support portions, while the charging roller is arranged as being in contact with the charged object by pressing the pair of support portions with a pair of pressing portions made up of a spring or the like. In general, a charging roller in which a highly resistive conductive surface layer is provided on an outer circumferential surface of a conductive shaft with a conductive rubber layer being interposed is employed as the charging roller.

In the contact type charger including the charging roller, normally, in order to ensure slidability between the charging roller and the support portion in a portion where the support portions described above are arranged, a conductive shaft is exposed without the conductive rubber layer and the conductive surface layer described above being provided on the charging roller. Therefore, the conductive shaft and the charged object are directly opposed to each other in that portion.

When no measures are taken, discharging may occur in that portion due to breakdown of air. When such discharging occurs, an excessively high leakage current accordingly flows through the charged object. Consequently, the charged object may be burnt down or a high-voltage circuit for generating a charging bias may be broken.

In order to solve this problem, normally, a long creepage distance between the conductive shaft and the charged object is ensured by setting a thickness of the conductive rubber layer described above to approximately 2 [mm] so that occurrence of leakage at an axial end portion of the charging roller is suppressed.

For example, Japanese Laid-Open Patent Publications Nos. 10-186800, 2002-49217, and 2003-156920 disclose techniques for suppressing occurrence of leakage in an axial end portion of a charging roller.

When the conductive rubber layer is provided as described above, however, the charging roller is increased in diameter by a thickness of the conducive rubber layer. Therefore, reduction in size of the charger is interfered, which gives rise to another problem. In particular, in a tandem type image forming apparatus including a plurality of imaging units, chargers as many as the imaging units are required and improvement in this aspect has strongly been demanded.

In order to solve this problem, use of a charging roller obtained by directly coating an outer circumferential surface of a conductive shaft with a high-resistance coating has been contemplated. The charging roller according to such a construction without a conductive rubber layer can be smaller in diameter than the charging roller with the conductive rubber layer described above and greatly contributes to reduction in size of the charger.

In the charging roller obtained by directly coating the outer circumferential surface of the conductive shaft with the high-resistance coating, however, the high-resistance coating has a thickness only approximately from ten [μm] to several hundred [μm]. Therefore, when no measures are taken, leakage described above noticeably occurs in an axial end portion of the conductive shaft where the high-resistance coating is not formed.

SUMMARY

An object of the present disclosure is to provide a charger which can be reduced in size and can suppress occurrence of leakage in an axial end portion of a charging roller and an image forming apparatus including the same.

To achieve at least one of the abovementioned objects, according to one aspect of the present invention, a charger reflecting one aspect of the present disclosure comprises a charging roller, a pair of support portions which rotationally supports the charging roller by supporting a pair of axial end portions of the charging roller, and a pair of pressing portions which presses the charging roller toward a charged object by biasing the pair of support portions. The charging roller includes a pair of first regions which is opposed to the pair of support portions in a radial direction and a second region located between the pair of first regions in an axial direction. The charging roller includes a substantially columnar conductive shaft located across the pair of first regions and the second region, a pair of end part cover portions which is in contact with and covers at least a part of outer circumferential surfaces of portions of the conductive shaft corresponding to the pair of first regions and is in slide contact with the pair of support portions, and a high-resistance coating which is in contact with and covers at least a part of an outer circumferential surface of a portion of the conductive shaft corresponding to the second region and abuts on an outer circumferential surface of a charged object to charge the charged object. An inner end portion of each of the pair of end part cover portions along the axial direction of the conductive shaft is covered with the high-resistance coating. A thickness of the high-resistance coating in a portion which is in contact with and covers an outer circumferential surface of the conductive shaft is equal to or greater than a thickness of the pair of end part cover portions in portions which are in contact with and cover the outer circumferential surface of the conductive shaft.

To achieve at least one of the abovementioned objects, according to one aspect of the present invention, an image forming apparatus reflecting one aspect of the present disclosure comprises a photoconductor as a charged object and the charger based on one aspect of the present disclosure described above.

To achieve at least one of the abovementioned objects, according to another aspect of the present invention, an image forming apparatus reflecting another aspect of the present disclosure comprises the charger based on one aspect of the present disclosure described above, the charger including the charging roller after preparatory rotational operation, by being configured such that the preparatory rotational operation is performed upon detecting implementation of the charger before formation of an image.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 13 is a table showing results of a first verification test.

DETAILED DESCRIPTION OF EMBODIMENTS

Figure 1:
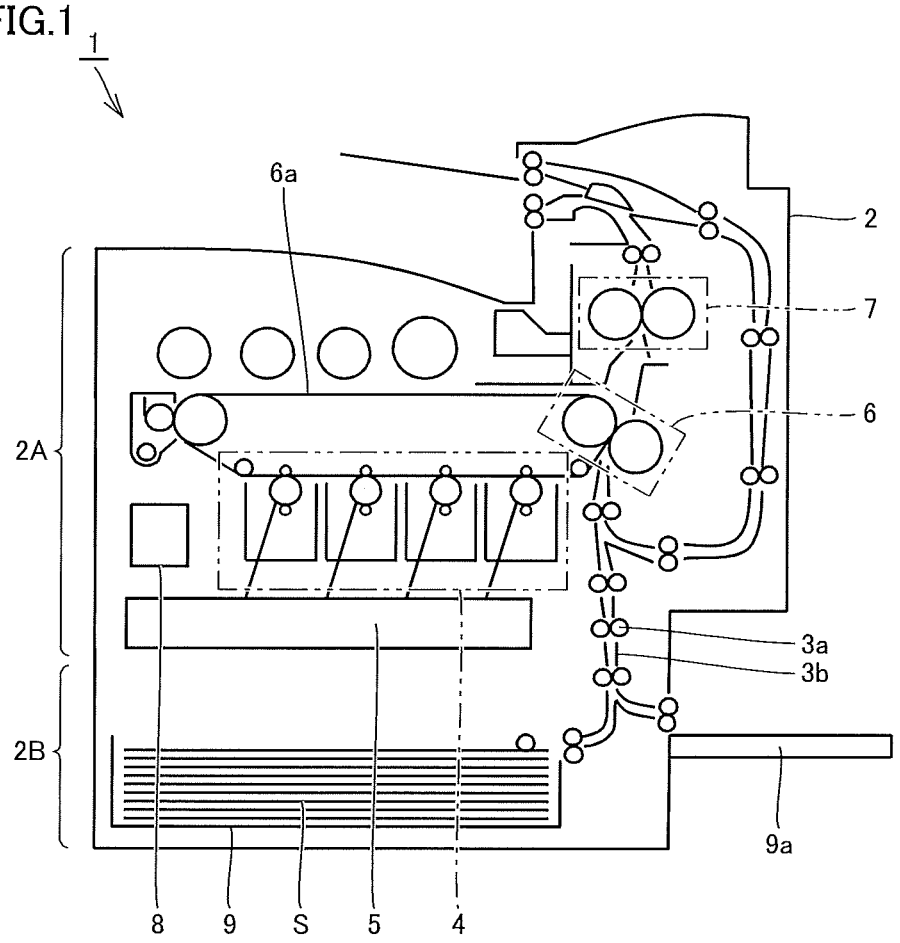
FIG. 1 is a schematic diagram of an image forming apparatus in a first embodiment.

Hereinafter, one or more embodiments of the present invention will be described with reference to the drawings. However, the scope of the invention is not limited to the disclosed embodiments.

In the embodiments shown below, what is called a tandem type color printer adapted to electrophotography and a charger incorporated therein are described by way of example of an image forming apparatus and a charger to which the present invention is applied, respectively. The same or common elements in the embodiments shown below have the same reference characters allotted in the drawings and description thereof will not be repeated.

First Embodiment

Figure 2:
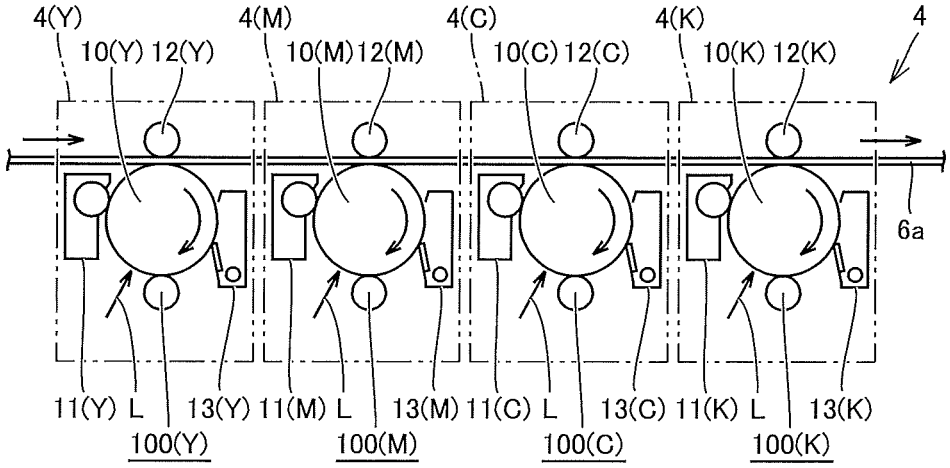
FIG. 2 is a schematic diagram of an imaging portion shown in FIG. 1.

FIG. 1 is a schematic diagram of an image forming apparatus in a first embodiment and FIG. 2 is a schematic diagram of an imaging portion shown in FIG. 1. A schematic construction of an image forming apparatus 1 in the present embodiment will initially be described with reference to FIGS. 1 and 2.

As shown in FIG. 1, image forming apparatus 1 mainly includes an apparatus main body 2 and a paper feed unit 9. Apparatus main body 2 includes an image forming portion 2A which is a portion for forming an image on paper S and a paper feed portion 2B which is a portion for supplying paper S to image forming portion 2A. Paper feed unit 9 accommodates paper S to be supplied to image forming portion 2A and provided as being attachable to and removable from paper feed portion 2B.

In image forming apparatus 1, various rollers 3*a* are provided across image forming portion 2A and paper feed portion 2B described above so that a transportation path 3*b* through which paper S is transported along a prescribed direction is defined. As shown in the figure, paper feed portion 2B may separately be provided with a manual feed tray 9*a* for supply of paper S to image forming portion 2A.

Image forming portion 2A mainly includes an imaging portion 4 which can form a toner image of each color, an exposure unit 5 which exposes rotatably constructed photoconductors 10(Y), 10(M), 10(C), and 10(K) (see FIG. 2) included in imaging portion 4 to light, an intermediate transfer belt 6*a* wound around imaging portion 4, a transfer portion 6 provided on transportation path 3*b* and on a pathway for intermediate transfer belt 6*a*, a fixing portion 7 provided on transportation path 3*b* in a portion downstream from transfer portion 6, and a control unit 8 which controls overall operations of image forming apparatus 1.

As shown in FIG. 2, imaging portion 4 includes imaging units 4(Y), 4(M), 4(C), and 4(K) which form toner images of respective colors of yellow (Y), magenta (M), cyan (C), and black (K).

Imaging units 4(Y), 4(M), 4(C), and 4(K) are constituted of photoconductors 10(Y), 10(M), 10(C), and 10(K) as well as chargers 100(Y), 100(M), 100(C), and 100(K), development apparatuses 11(Y), 11(M), 11(C), and 11(K), primary transfer rollers 12(Y), 12(M), 12(C), and 12(K), and cleaning apparatuses 13(Y), 13(M), 13(C), and 13(K) which are arranged sequentially around photoconductors 10(Y), 10(M), 10(C), and 10(K) from an upstream side along a direction of rotation thereof, respectively.

Intermediate transfer belt 6*a* described above is inserted between respective photoconductors 10(Y), 10(M), 10(C), and 10(K) and respective primary transfer rollers 12(Y), 12(M), 12(C), and 12(K), and intermediate transfer belt 6*a* is in contact with each of photoconductors 10(Y), 10(M), 10(C), and 10(K) in that portion.

In forming a toner image, initially, surfaces of photoconductors 10(Y), 10(M), 10(C), and 10(K) are charged by chargers 100(Y), 100(M), 100(C), and 100(K), respectively. Chargers 100(Y), 100(M), 100(C), and 100(K) are each implemented by a charger 100A in the present embodiment which will be described later, a detailed construction of which will be described later.

Electrostatic latent images are written to the surfaces of photoconductors 10(Y), 10(M), 10(C), and 10(K) as a result of irradiation of the surfaces of photoconductors 10(Y), 10(M), 10(C), and 10(K) with exposure light L by exposure unit 5.

Then, development apparatuses 11(Y), 11(M), 11(C), and 11(K) supply toner of respective corresponding colors to the surfaces of photoconductors 10(Y), 10(M), 10(C), and 10(K) so that toner images in accordance with the electrostatic latent images are formed on the surfaces of photoconductors 10(Y), 10(M), 10(C), and 10(K), respectively.

The toner images formed on the surfaces of photoconductors 10(Y), 10(M), 10(C), and 10(K) are thereafter transferred to intermediate transfer belt 6*a* by primary transfer rollers 12(Y), 12(M), 12(C), and 12(K), respectively (what is called primary transfer).

Thereafter, toner which remains on the surfaces of photoconductors 10(Y), 10(M), 10(C), and 10(K) is scraped off by cleaning apparatuses 13(Y), 13(M), 13(C), and 13(K).

Thus, toner images of respective colors are formed as being superimposed on the surface of intermediate transfer belt 6*a* by imaging units 4(Y), 4(M), 4(C), and 4(K), to thereby form a color toner image. When only imaging unit 4(K) is used, a monochrome toner image is formed on the surface of intermediate transfer belt 6*a*.

Intermediate transfer belt 6*a* transfers a color toner image or a monochrome toner image formed on the surface thereof to transfer portion 6, and it is brought in press contact between a pair of secondary transfer rollers in transfer portion 6 together with paper S transported from paper feed portion 2B to transfer portion 6. The color toner image or the monochrome toner image formed on the surface of intermediate transfer belt 6*a* is thus transferred to paper S (what is called secondary transfer).

Paper S to which the color toner image or the monochrome toner image is transferred is thereafter pressurized and heated by fixing portion 7. The color image or the monochrome image is thus formed on paper S. Thereafter, paper S on which the color image or the monochrome image is formed is ejected from apparatus main body 2 through transportation path 3*b*.

Since imaging units 4(Y), 4(M), 4(C), and 4(K) described above are basically similar in construction to one another, description will be given below, with photoconductors 10(Y), 10(M), 10(C), and 10(K) included in respective imaging units 4(Y), 4(M), 4(C), and 4(K) being simply denoted as photoconductor 10 without particular distinction thereamong, and with chargers 100(Y), 100(M), 100(C), and 100(K) included in respective imaging units 4(Y), 4(M), 4(C), and 4(K) being simply denoted as charger 100A in the present embodiment without particular distinction thereamong.

Figure 3:
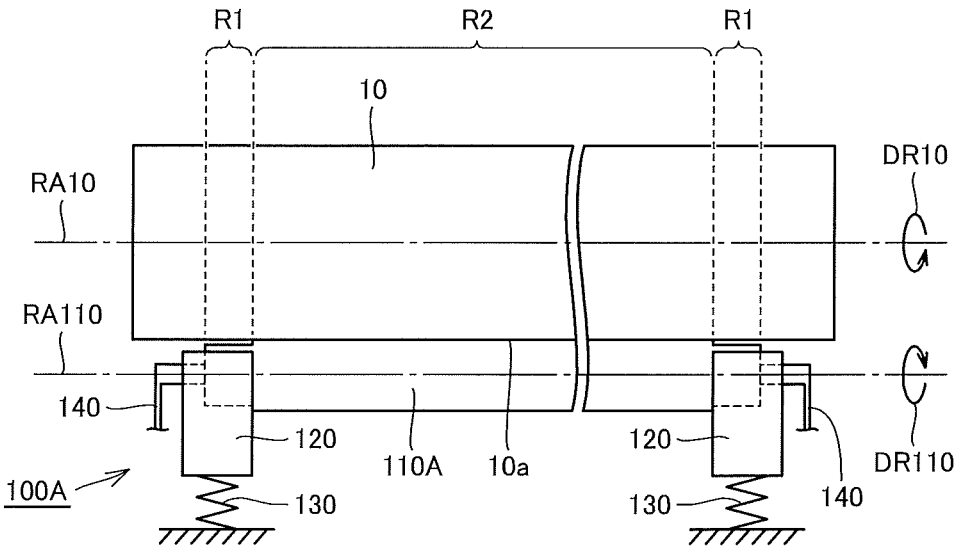
FIG. 3 is a schematic plan view showing a state of attachment of a charger in the first embodiment to the image forming apparatus.

FIG. 3 is a schematic plan view showing a state of attachment of the charger in the present embodiment to the image forming apparatus. A schematic construction of charger 100A in the present embodiment will now be described with reference to FIG. 3.

As shown in FIG. 3, charger 100A mainly includes a charging roller 110A, a pair of support portions 120, a pair of pressing portions 130, and a pair of contact points 140.

Charging roller 110A has a substantially columnar outer geometry. By being rotationally supported by the pair of support portions 120, charging roller 110A is constructed to be rotatable around its axial center (that is, around a rotation axis RA110 shown in the figure).

By supporting a pair of axial end portions of charging roller 110A, the pair of support portions 120 rotationally supports charging roller 110A. Each of the pair of support portions 120 is made, for example, of a member composed of a resin, and preferably composed of a resin material particularly high in slidability and strength. From this point of view, the pair of support portions 120 is composed, for example, of any of a polyacetal resin, a polyamide resin, a polytetrafluoroethylene resin, a polyphenylene sulfide resin, a polyether ether ketone resin, and a polyamide-imide resin, or a resin to which various additives for improvement in slidability and strength are added.

The pair of axial end portions of charging roller 110A is rotationally supported by the pair of support portions 120 so that charging roller 110A has a pair of first regions R1 which is opposed to the pair of support portions 120 in a radial direction and a second region R2 located between the pair of first regions R1 in an axial direction. Second region R2 of charging roller 110A is opposed to neither of the pair of support portions 120 in the radial direction.

The pair of pressing portions 130 presses charging roller 110A toward photoconductor 10 as a charged object by biasing the pair of support portions 120. Each of the pair of pressing portions 130 can be made up, for example, of a spring.

The pair of contact points 140 is formed from a terminal made of a metal with spring elasticity and serves to supply a prescribed voltage to charging roller 110A. The pair of contact points 140 abuts on a pair of axial end surfaces of charging roller 110A so that a charging bias is applied to charging roller 110A.

Only a direct-current (DC) bias may be applied as the charging bias, or a bias resulting from superimposition of an alternating-current (AC) bias on a DC bias may be applied. Normally, when only a DC bias is applied, a voltage approximately not lower than 0.8 [kV] and not higher than 1.4 [kV] is supplied to charging roller 110A, and when a bias resulting from superimposition of an AC bias on a DC bias is applied, a voltage at approximately 2 [kV] at the maximum is supplied to charging roller 110A.

In charger 100A in the present embodiment, from a point of view of suppression of occurrence of leakage, a voltage is supplied to charging roller 110A such that intensity of electric field in a space between charging roller 110A and photoconductor 10 is not higher than 1.5 [kV/mm] (more preferably not higher than 1.3 [kV/mm]).

Charger 100A thus constructed is attached to image forming apparatus 1 such that charging roller 110A abuts on an outer circumferential surface 10*a* of photoconductor 10. Charging roller 110A is arranged as lying between the pair of support portions 120 and photoconductor 10 and the pair of pressing portions 130 is arranged such that the pair of support portions 120 is biased toward photoconductor 10. Thus, charging roller 110A is constructed to abut on outer circumferential surface 10*a* of photoconductor 10.

Photoconductor 10 has a substantially columnar outer geometry, and is rotationally driven around its axial center in a direction shown with an arrow DR10 in the figure by a not-shown drive motor. Charging roller 110A which abuts on outer circumferential surface 10*a* of photoconductor 10 thus rotates as following rotation of photoconductor 10 in a direction shown with an arrow DR110 in the figure. As a prescribed charging bias is applied to charging roller 110A as described above, outer circumferential surface 10*a* of photoconductor 10 in a portion corresponding to second region R2 of charging roller 110A is charged.

Replacement of the charger attached to the image forming apparatus may be required as necessary. Therefore, in consideration of convenience of a replacement operation, generally, the image forming apparatus and the charger are often constructed such that not only the charging roller but also the entire charger is attachable to and removable from the image forming apparatus. Image forming apparatus 1 and charger 100A in the present embodiment are also constructed such that entire charger 100A is replaceable.

Charger 100A in the present embodiment is contemplated to initially perform a preparatory rotational operation while it is attached to image forming apparatus 1 as will be described later, and the construction of charger 100A is slightly different between before and after the preparatory rotational operation. Therefore, in the description below, a further detailed construction of charger 100A will be described for each of a state before the preparatory rotational operation (that is, an unused state) and a state after the preparatory rotational operation (that is, a used state).

Figure 4:
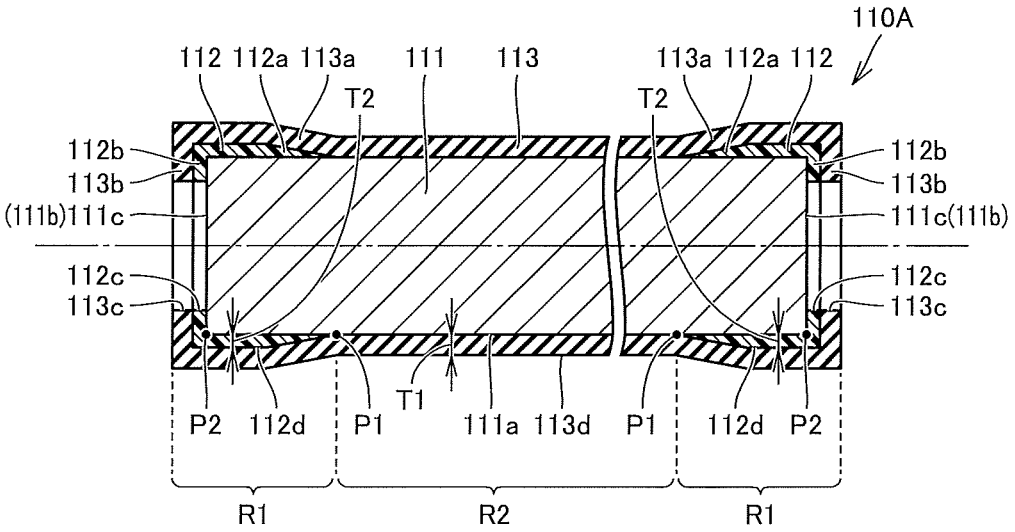
FIG. 4 is a schematic cross-sectional view of an unused state of a charging roller shown in FIG. 3.

FIG. 4 is a schematic cross-sectional view of an unused state of the charging roller shown in FIG. 3. A construction of charging roller 110A in the unused state will initially be described in detail.

As shown in FIG. 4, charging roller 110A includes a conductive shaft 111, a pair of end part cover portions 112, and a high-resistance coating 113.

Conductive shaft 111 has a columnar outer geometry including an outer circumferential surface 111*a* and a pair of axial end surfaces 111*b*. Conductive shaft 111 is preferably composed of a material low in electrical resistance and high in strength. From such a point of view, conductive shaft 111 is made, for example, of stainless steel excellent in corrosion resistance and low in metal fatigue.

Conductive shaft 111 has a diameter, for example, of approximately 6 [mm] when a maximum paper size which is applicable to printing by image forming apparatus 1 is set to an A4 size. In order to ensure uniform charging of photoconductor 10, a conductive shaft without a flaw such as a scratch in outer circumferential surface 111*a* with surface roughness being, for example, not higher than 3.2 S, is preferably employed as conductive shaft 111.

Conductive shaft 111 is constructed to have such a size (that is, a length in the axial direction) that it can extend across first regions R1 and second region R2 described above while charger 100A is attached to image forming apparatus 1.

The pair of end part cover portions 112 is provided to cover the pair of axial end portions of conductive shaft 111. More specifically, the pair of end part cover portions 112 is in contact with and covers outer circumferential surface 111*a* of conductive shaft 111 in the pair of axial end portions of conductive shaft 111. Each of the pair of end part cover portions 112 has an inner end portion P1 along the axial direction of conductive shaft 111 and continuously extends to reach an axial outer end P2 of conductive shaft 111 from inner end portion P1.

A tapered portion 112*a* is formed in a portion closer to inner end portion P1 of each of the pair of end part cover portions 112. Tapered portion 112*a* is a portion in an inclined shape gradually decreasing in thickness toward a central portion in the axial direction of conductive shaft 111 and a tip end portion of tapered portion 112*a* corresponds to inner end portion P1 described above.

Each of the pair of end part cover portions 112 is provided with an extension portion 112*b* which continuously extends to reach an outer circumferential edge portion of axial end surface 111*b* of conductive shaft 111 beyond above-described outer end P2 of conductive shaft 111. Extension portion 112*b* is provided with an opening 112*c* for exposure of a part of axial end surface 111*b* of conductive shaft 111.

The pair of end part cover portions 112 should be made of an insulating or highly resistive member, and should further be made of a member higher in slidability and strength than high-resistance coating 113. Furthermore, the pair of end part cover portions 112 is preferably composed of a resin material high in Young's modulus. From such a point of view, the pair of end part cover portions 112 is composed, for example, of any of a polyester resin, a methyl methacrylate resin, a polystyrene resin, a polyethylene resin, a polyamide resin, a polyacetal resin, a polycarbonate resin, a nylon resin, a polypropylene resin, a polyurethane resin, a polyvinyl chloride resin, a silicone resin, a polyethylene terephthalate resin, a polyvinylidene fluoride resin, and a polytetrafluoroethylene resin. In particular, the pair of end part cover portions 112 is preferably composed of a polyacetal resin or a polyethylene resin so that an amount of deformation thereof can be suppressed when it is pressed by pressing portions 130 with support portions 120 being interposed.

The pair of end part cover portions 112 can be formed, for example, by fitting a member made of a resin which has been formed in advance into a cup shape to the pair of axial end portions of conductive shaft 111 and assembling the member made of the resin to the pair of axial end portions of conductive shaft 111 by heating the same. In this case, from a point of view of intimate contact of the pair of end part cover portions 112 with conductive shaft 111, the pair of end part cover portions 112 is preferably made of a heat shrinkable member, and it is preferably composed, for example, of any of a polyethylene resin, a polyvinyl chloride resin, a silicone resin, a polyethylene terephthalate resin, a polyvinylidene fluoride resin, and a polytetrafluoroethylene resin.

The pair of end part cover portions 112 preferably has a volume resistivity not lower than $10^{11}$[Ω·cm]. According to such a feature, a flow of an excessively high current through end part cover portion 112 can be suppressed.

The pair of end part cover portions 112 preferably has a Mohs hardness not lower than 2 and not higher than 4. According to such a feature, end part cover portion 112 achieves improved wear resistance and charger 100A can have a longer lifetime.

The pair of end part cover portions 112 preferably has a coefficient of friction against nonwoven fabric not higher than 0.29. According to such a feature, slidability of end part cover portion 112 against the support portion is improved. Therefore, followability of charging roller 110A to photoconductor 10 can be ensured and photoconductor 10 can more uniformly be charged. The feature that followability of charging roller 110A to photoconductor 10 can be ensured by setting the pair of end part cover portions 112 to have a coefficient of friction against nonwoven fabric of 0.29 or lower is a finding obtained based on results in a first verification test which will be described later.

The pair of end part cover portions 112 is constructed to cover portions of conductive shaft 111 corresponding to first regions R1 described above while charger 100A is attached to image forming apparatus 1.

High-resistance coating 113 is provided to cover substantially the entire conductive shaft 111. More specifically, high-resistance coating 113 is in contact with and covers outer circumferential surface 111*a* of a portion located between the pair of axial end portions of conductive shaft 111 (that is, a portion located between the portions of conductive shaft 111 covered with the pair of end part cover portions 112) and continuously extends to be in contact with and cover outer circumferential surfaces 112*d* of the pair of end part cover portions 112.

The outer circumferential surface of charging roller 110A is thus defined by an outer circumferential surface 113*d* of high-resistance coating 113, and inner end portions P1 of the pair of end part cover portions 112 are covered with high-resistance coating 113.

High-resistance coating 113 is composed of a thermoplastic resin composition in which a high-polymer ion conductive agent is dispersed. The thermoplastic resin composition is composed, for example, of any of a polyethylene resin, a polypropylene resin, methyl polymethacrylate, a polystyrene resin, and a copolymer resin thereof. The high-polymer ion conductive agent is composed, for example, of a high-polymer compound containing a poly(ether ester amide) component.

Poly(ether ester amide) is an ion conductive high-polymer material and fixed as being uniformly dispersed on the molecular level in a matrix polymer. Thus, a high-polymer compound containing the poly(ether ester amide) component is free from variation in resistance value due to insufficient dispersion as seen in a composition in which an electron-conductive conductive agent such as a metal oxide and carbon black is dispersed, and it is also less likely to cause bleed-out because the high-polymer compound is a high-polymer material.

High-resistance coating 113 has a thickness not smaller than 10 [μm] and not greater than 270 [μm] and preferably not smaller than 10 [μm] and not greater than 170 [μm]. This is because, as high-resistance coating 113 has a smaller thickness, pinholes are more likely in high-resistance coating 113 during manufacturing and thus occurrence of leakage is more likely, and in order to avoid such an unfavorable condition, a thickness is preferably not smaller than 10 [μm]. That is also because, as high-resistance coating 113 has a greater thickness, variation in thickness of high-resistance coating 113 is more likely during manufacturing and consequently charging is more likely to be uneven, and in order to avoid such an unfavorable condition, a thickness is preferably not greater than 270 [μm] (more suitably not greater than 170 [μm]).

High-resistance coating 113 can be formed by preparing a solution in which a coating material is dissolved in an organic solvent and applying the solution to conductive shaft 111 by using such an application method as dipping, spray coating, and roll coating. By providing the pair of end part cover portions 112 in conductive shaft 111 in advance, high-resistance coating 113 can be formed to cover the pair of end part cover portions 112.

High-resistance coating 113 thus formed has an inclined portion 113*a* in a portion covering tapered portion 112*a* of each of the pair of end part cover portions 112. In the portion where inclined portion 113*a* is formed, an outer diameter of charging roller 110A defined by outer circumferential surface 113*d* of high-resistance coating 113 gradually decreases toward the central portion in the axial direction of conductive shaft 111.

The pair of axial end portions of high-resistance coating 113 is each provided with an extension portion 113*b* which continuously extends to reach the outer circumferential edge portion of axial end surface 111*b* of conductive shaft 111 beyond above-described outer end P2 of conductive shaft 111. Extension portion 113*b* is provided with an opening 113*c* for exposure of a part of axial end surface 111*b* of conductive shaft 111.

Outer circumferential surface 113*d* of high-resistance coating 113 preferably has such surface roughness that ten-spot average roughness Rz defined under JIS B0601: 2001 is not greater than 10 [μm] in order to ensure uniform charging of photoconductor 10.

High-resistance coating 113 is constructed to cover the portions corresponding to above-described first regions R1 and second region R2 of conductive shaft 111 across the same while charger 100A is attached to image forming apparatus 1.

The pair of end part cover portions 112 is constructed to be smaller in thickness than high-resistance coating 113. More specifically, a thickness T1 of high-resistance coating 113 of the portion being in contact with and covering outer circumferential surface 111*a* of conductive shaft 111 is set to be greater than a thickness T2 of the pair of end part cover portions 112 in the portions being in contact with and covering the outer circumferential surface of conductive shaft 111 (that is, T1>T2).

As described above, in charging roller 110A in the unused state, outer circumferential surface 111*a* of conductive shaft 111 is covered with the pair of end part cover portions 112 in the pair of axial end portions of conductive shaft 111, outer circumferential surface 111*a* of conductive shaft 111 in the portion located between the portions covered with the pair of end part cover portions 112 is covered with high-resistance coating 113, and outer circumferential surfaces 112*d* of the pair of end part cover portions 112 are covered with high-resistance coating 113.

High-resistance coating 113 is provided to continuously extend across outer circumferential surface 111*a* of conductive shaft 111 in the portion located between the portions covered with the pair of end part cover portions 112 and outer circumferential surfaces 112*d* of the pair of end part cover portions 112, so that inner end portion P1 along the axial direction of conductive shaft 111 of each of the pair of end part cover portions 112 is covered with high-resistance coating 113.

Thickness T2 of the pair of end part cover portions 112 is set to be smaller than thickness T1 of high-resistance coating 113.

The pair of axial end surfaces 111*b* of charging roller 110A is exposed to the outside through openings 112*c* provided in extension portions 112*b* of the pair of end part cover portions 112 covering the same and openings 113*c* provided in the pair of extension portions 113*b* of high-resistance coating 113 covering the same, so that an exposed region 111*c* is provided in each of the pair of axial end surfaces 111*b*. Contact point 140 described above is arranged in exposed region 111*c* as being in contact therewith.

In charger 100A including charging roller 110A in the unused state thus constructed, initially, the preparatory rotational operation is performed as described above while charger 100A is attached to image forming apparatus 1. The preparatory rotational operation is an operation for rotating photoconductor 10 only for a prescribed period of time or only prescribed number of times of rotation prior to formation of an image, so that charging roller 110A rotates as following the rotation of the photoconductor.

The preparatory rotational operation is performed, for example, when control unit 8 provided in image forming apparatus 1 receives a signal indicating sensing of attachment of the charger to image forming apparatus 1 and drives a drive motor which drives photoconductor 10. The signal may be configured to be generated by a sensing portion implemented by various sensors which automatically sense attachment of the charger to image forming apparatus 1 or by an operation onto an input portion such as a push button. When the sensing portion generates the signal, image forming apparatus 1 is preferably configured to be able to sense that the charger attached to image forming apparatus 1 is a new product (that is, an unused product).

In this preparatory rotational operation, the outer circumferential surface of charging roller 110A in the portions rotationally supported by the pair of support portions 120 is defined by high-resistance coating 113 as described above. Therefore, high-resistance coating 113 in these portions are in slide contact with support portions 120. Since high-resistance coating 113 is small in thickness and weak, it is worn by friction against support portions 120 and the pair of end part cover portions 112 located inside high-resistance coating 113 is exposed.

Therefore, during formation of an image after the preparatory rotational operation, the pair of end part cover portions 112 is exposed and the pair of end part cover portions 112 and the pair of support portions 120 are in slide contact with each other, which will be described in further detail below.

Figure 5A:
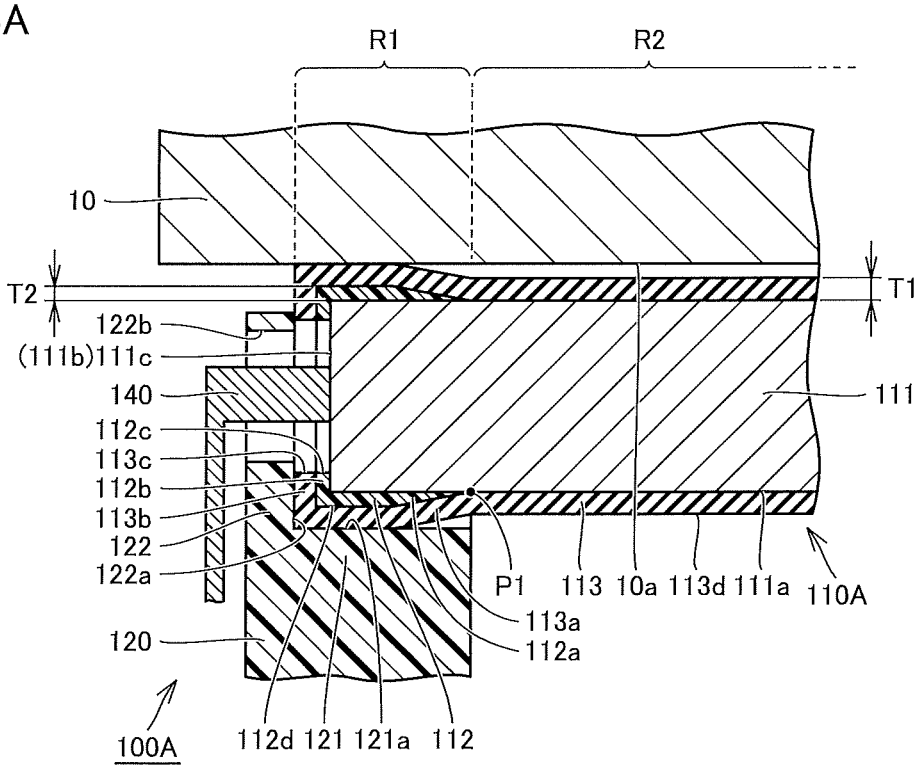
FIGS. 5A and 5B are schematic cross-sectional views showing states of a main portion before and after a preparatory rotational operation while the charger shown in FIG. 3 is attached to the image forming apparatus, respectively.
Figure 5B:
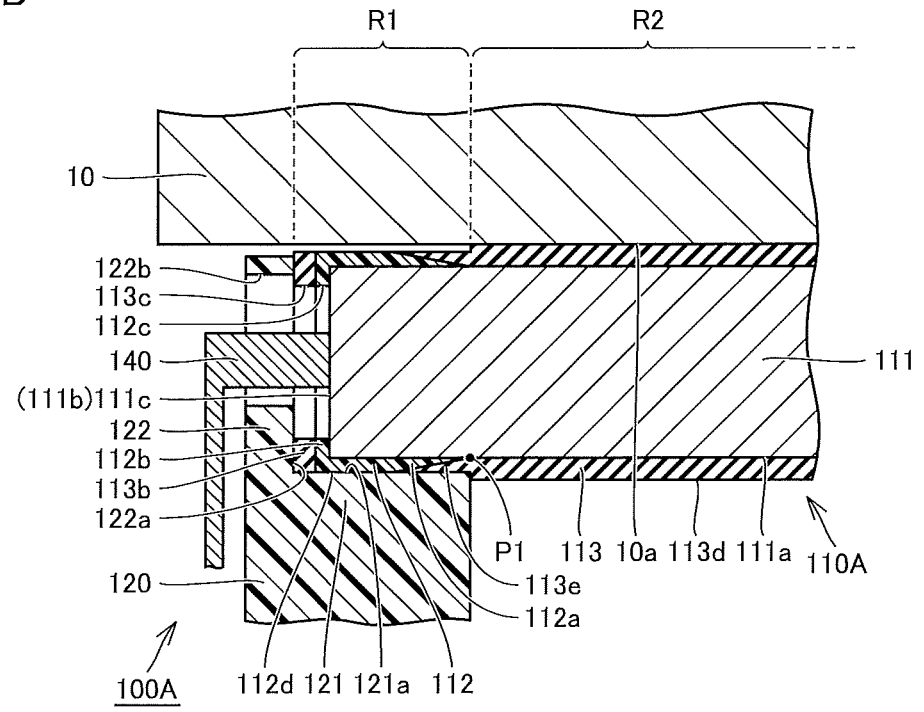
Figure 6:
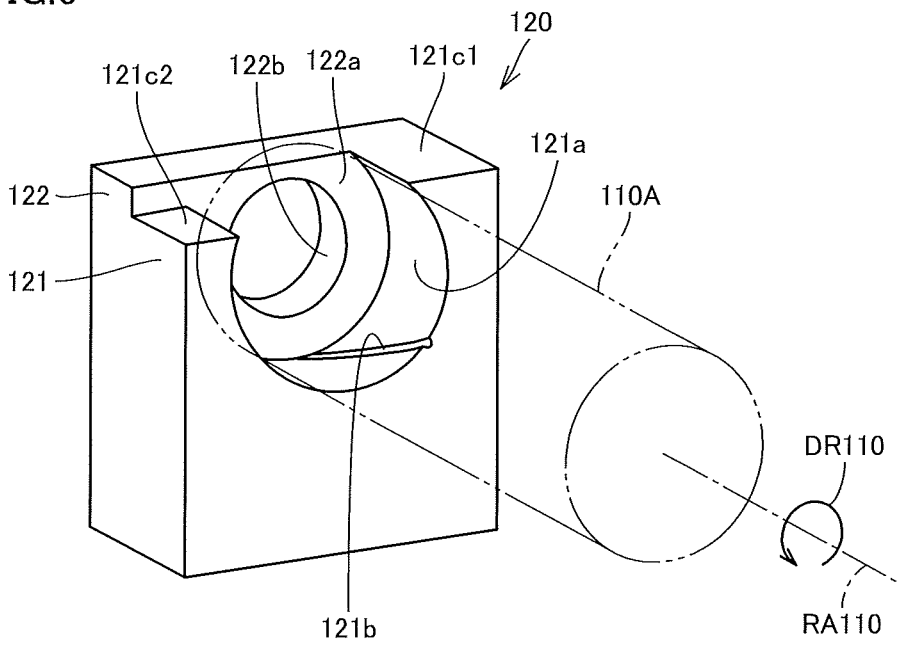
FIG. 6 is a schematic perspective view of the vicinity of a support portion of the charger shown in FIG. 3.

FIGS. 5A and 5B are diagrams showing states of attachment of the charger shown in FIG. 3 to the image forming apparatus. FIG. 5A is a schematic cross-sectional view showing a state before the preparatory rotational operation of a main portion and FIG. 5B is a schematic cross-sectional view showing a state after the preparatory rotational operation of the main portion. FIG. 6 is a schematic perspective view of the vicinity of a support portion of the charger shown in FIG. 3. FIGS. 5A, 5B, and 6 show only one of the pair of axial end portions of charging roller 110A.

As shown in FIGS. 5A and 5B, in charger 100A in the present embodiment, inner end portions P1 of the pair of end part cover portions 112 are arranged in alignment with boundary positions between the portions corresponding to the pair of first regions R1 of conductive shaft 111 and the portion corresponding to second region R2 of conductive shaft 111. The pair of end part cover portions 112 is thus arranged only in first regions R1 in the axial direction of charging roller 110A.

As described above, charging roller 110A has the pair of axial end portions rotationally supported by the pair of support portions 120. The pair of support portions 120 holds charging roller 110A in the radial direction and also in the axial direction.

More specifically, as shown in FIGS. 5A, 5B, and 6, each of the pair of support portions 120 has a base portion 121 which defines a slide contact surface 121*a* which is in slide contact with the outer circumferential surface of the axial end portion of charging roller 110A and an end wall portion 122 which is opposed to the axial end surface of charging roller 110A and defines a closing surface 122*a* continuous to slide contact surface 121*a*.

Each of the pair of axial end portions of charging roller 110A is inserted in a space defined by slide contact surface 121*a* and closing surface 122*a* of each of the pair of support portions 120, so that charging roller 110A is rotationally supported by the pair of support portions 120.

A portion of base portion 121 arranged on a side of photoconductor 10 is provided with a cut portion, and the space defined by slide contact surface 121*a* and closing surface 122*a* described above opens to the outside through the cut portion. Charging roller 110A described above is arranged such that a part thereof extends off from support portion 120 through the cut portion so that charging roller 110A abuts on photoconductor 10 without contact of support portion 120 with photoconductor 10.

A window portion 122*b* in a form of a through hole is provided at a prescribed position in end wall portion 122 in the portion defining closing surface 122*a*. Contact point 140 described above is inserted in window portion 122*b* so as to be in contact with exposed region 111*c* of conductive shaft 111.

As shown in FIG. 5A, before the preparatory rotational operation, charging roller 110A and photoconductor 10 are in contact with each other only in the pair of axial end portions of charging roller 110A, and charging roller 110A and photoconductor 10 are not in contact with each other in a portion except for the pair of axial end portions.

This is because end part cover portions 112 are provided only in the pair of axial end portions of charging roller 110A. Therefore, before the preparatory rotational operation, a distance between conductive shaft 111 and photoconductor 10 is maintained at a distance in accordance with the sum of thickness T1 of high-resistance coating 113 and thickness T2 of end part cover portion 112.

Before the preparatory rotational operation, high-resistance coating 113 in the portions of charging roller 110A which covers outer circumferential surfaces 112*d* of the pair of end part cover portions 112 is opposed to slide contact surfaces 121*a* of the pair of support portions 120.

As the preparatory rotational operation is performed in this state, high-resistance coating 113 in the portions of charging roller 110A which covers outer circumferential surfaces 112*d* of the pair of end part cover portions 112 is in slide contact with slide contact surfaces 121*a* of the pair of support portions 120 so that high-resistance coating 113 in those portions is worn and outer circumferential surfaces 112*d* of the pair of end part cover portions 112 are partially exposed.

Remainders of high-resistance coating 113 which are peeled off from charging roller 110A as a result of being worn may lower quality of an image during formation of the image as they adhere to photoconductor 10 or charging roller 110A. For example, when the remainders of high-resistance coating 113 adhere to photoconductor 10, they may be introduced into a development apparatus or a cleaning apparatus or moved to the intermediate transfer belt which results in defective formation of an image. Therefore, charger 100A in the present embodiment is constructed such that the remainders of high-resistance coating 113 are properly removed.

Specifically, as shown in FIG. 6, a groove 121*b* which extends in a direction oblique to the axial direction (that is, a direction of extension of rotation axis RA110 shown in the figure) of charging roller 110A is provided at a prescribed position in above-described slide contact surface 121*a* of support portion 120. Groove 121*b* serves to catch the remainders of high-resistance coating 113.

Groove 121*b* is provided obliquely such that, of one end portion and the other end portion located in the direction of extension of groove 121*b*, the one end portion which is an end portion located on a side of end wall portion 122 is located upstream from the other end portion in the direction of rotation of charging roller 110A (that is, a direction shown with arrow DR110 in the figure).

According to such a construction, the remainders of high-resistance coating 113 caught in groove 121*b* are moved toward the other end portion along the direction of extension of groove 121*b* as a result of rotation of charging roller 110A and finally discharged from groove 121*b* to the outside. Therefore, the remainders of high-resistance coating 113 can be prevented from adhering to photoconductor 10 and charging roller 110A and lowering in quality of an image can be suppressed.

An end surface 121*c*2 located downstream in the direction of rotation of charging roller 110A (that is, the direction shown with arrow DR110 shown in the figure) of a pair of end surfaces 121*c*1 and 121*c*2 of base portion 121 arranged on a side of photoconductor 10 is provided as being retracted and arranged farther from photoconductor 10 than end surface 121*c*1 located upstream in the direction of rotation of charging roller 110A.

According to such a construction, the remainders of high-resistance coating 113 which have not fully been caught in groove 121*b* described above are stored on end surface 121*c*2 of base portion 121, so that the remainders of high-resistance coating 113 can be prevented from adhering to photoconductor 10 and charging roller 110A and lowering in quality of an image can be suppressed.

As shown in FIG. 5B, after the preparatory rotational operation, as described above, a part of outer circumferential surfaces 112*d* of the pair of end part cover portions 112 is exposed and exposed outer circumferential surface 112*d* of end part cover portion 112 and slide contact surface 121*a* of support portion 120 are opposed to each other.

After the preparatory rotational operation, charging roller 110A and photoconductor 10 are in contact with each other only in the portion except for the pair of axial end portions of charging roller 110A, and charging roller 110A and photoconductor 10 are not in contact with each other in the pair of axial end portions.

This is because high-resistance coating 113 in the portions located in the pair of axial end portions of charging roller 110A is worn in the preparatory rotational operation and thickness T2 of the pair of end part cover portions 112 is smaller than thickness T1 of high-resistance coating 113. Therefore, after the preparatory rotational operation, a distance between conductive shaft 111 and photoconductor 10 is maintained at a distance in accordance with thickness T1 of high-resistance coating 113.

When photoconductor 10 is rotationally driven for formation of an image in this state, outer circumferential surfaces 112*d* of the pair of end part cover portions 112 of charging roller 110A are in slide contact with slide contact surfaces 121*a* of the pair of support portions 120. Since the pair of end part cover portions 112 is made up of a member higher in slidability and strength than high-resistance coating 113 as described above, the end part cover portion is not worn and charging roller 110A smoothly rotates as following rotation of the photoconductor.

A part (that is, a portion located on an outer side relative to end part cover portion 112 in the radial direction of charging roller 110A) of the portion of high-resistance coating 113 which corresponds to inclined portion 113*a* described above is worn in the preparatory rotational operation, whereas a part thereof (that is, a portion located on an inner side of end part cover portion 112 in the radial direction of charging roller 110A) remains without being worn. Therefore, after the preparatory rotational operation, tapered portion 112*a* of each of the pair of end part cover portions 112 is maintained as being covered with a remaining portion 113*e* of high-resistance coating 113.

Therefore, inner end portion P1 along the axial direction of conductive shaft 111 of each of the pair of end part cover portions 112 is maintained as being covered with high-resistance coating 113 also after the preparatory rotational operation.

As set forth above, after the preparatory rotational operation, such a state that conductive shaft 111 is not exposed in the pair of axial end portions of charging roller 110A but conductive shaft 111 is continuously covered with the pair of end part cover portions 112 and high-resistance coating 113 along the axial direction can be realized and occurrence of leakage in that portion can be suppressed.

Since the outer circumferential edges of the pair of axial end surfaces of conductive shaft 111 are also covered with extension portions 112*b* of the pair of end part cover portions 112 and the pair of extension portions 113*b* of high-resistance coating 113, a creepage distance between photoconductor 10 and conductive shaft 111 can be ensured and occurrence of leakage can be suppressed also in those portions.

Therefore, by adopting the construction, charging roller 110A can be reduced in diameter owing to absence of the conductive rubber layer in charging roller 110A, and occurrence of leakage in the axial end portion of charging roller 110A can be suppressed by providing end part cover portion 112 in each of the pair of axial end portions of charging roller 110A. Therefore, a charger which can be reduced in size and can achieve suppression of occurrence of leakage in axial end portions of a charging roller and an image forming apparatus including the same can be obtained.

Second Embodiment

Figure 7A:
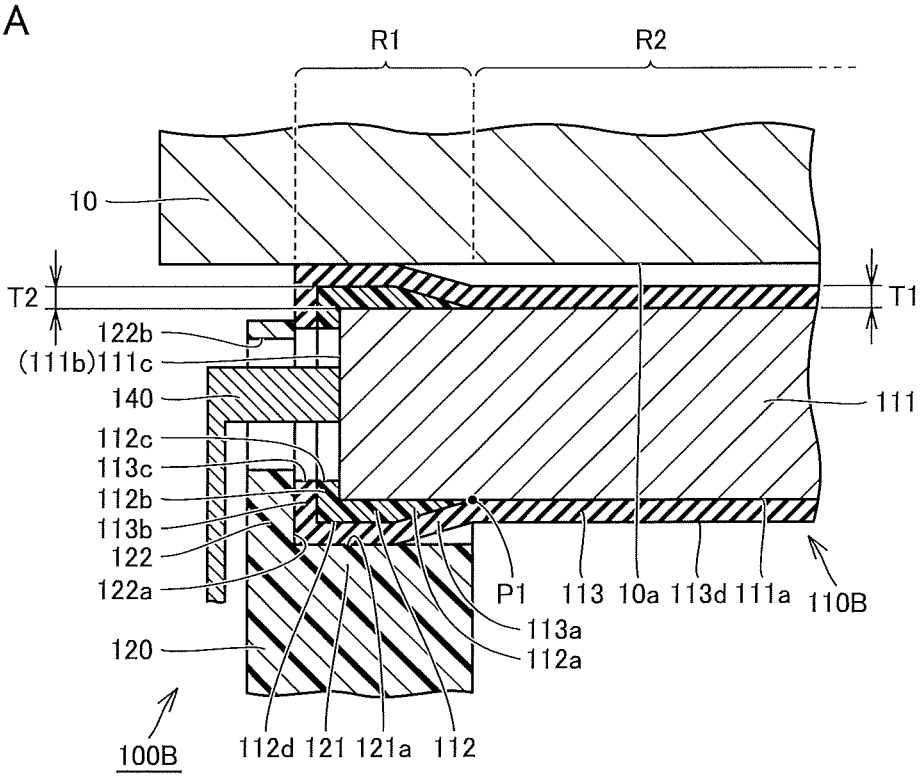
FIGS. 7A and 7B are schematic cross-sectional views showing states of the main portion before and after the preparatory rotational operation while a charger in a second embodiment is attached to the image forming apparatus, respectively.
Figure 7B:
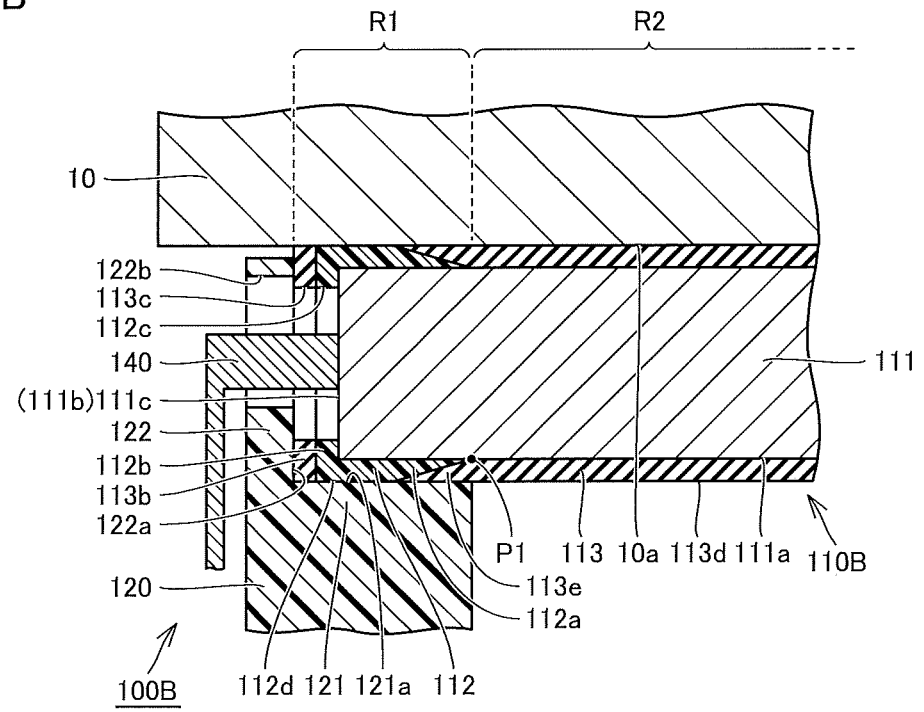

FIGS. 7A and 7B are diagrams showing states of attachment of a charger in a second embodiment to the image forming apparatus. FIG. 7A is a schematic cross-sectional view showing a state before the preparatory rotational operation of the main portion and FIG. 7B is a schematic cross-sectional view showing a state after the preparatory rotational operation of the main portion. A charger 100B in the present embodiment will be described below with reference to FIGS. 7A and 7B. Charger 100B in the present embodiment is attached to image forming apparatus 1 in the first embodiment described above instead of charger 100A described above.

As shown in FIGS. 7A and 7B, charger 100B in the present embodiment is different from charger 100A in the first embodiment described above only in construction of a charging roller 110B and specifically only in thickness of the pair of end part cover portions 112.

More specifically, thickness T2 of the pair of end part cover portions 112 is set to be equal to a thickness of high-resistance coating 113. More specifically, thickness T1 of high-resistance coating 113 in a portion being in contact with and covering outer circumferential surface 111*a* of conductive shaft 111 is set to be equal to thickness T2 of the pair of end part cover portions 112 in the portions being in contact with and covering the outer circumferential surface of conductive shaft 111 (that is, T1=T2).

In this case, as shown in FIG. 7A, before the preparatory rotational operation, charging roller 110B and photoconductor 10 are in contact with each other only in the pair of axial end portions of charging roller 110B, and a distance between conductive shaft 111 and photoconductor 10 is maintained at a distance in accordance with the sum of thickness T1 of high-resistance coating 113 and thickness T2 of end part cover portion 112.

As the preparatory rotational operation is performed in this state, high-resistance coating 113 in the portions of charging roller 110 which covers outer circumferential surfaces 112*d* of the pair of end part cover portions 112 is in slide contact with slide contact surfaces 121*a* of the pair of support portions 120 so that high-resistance coating 113 in those portions is worn and outer circumferential surfaces 112*d* of the pair of end part cover portions 112 are partially exposed.

As shown in FIG. 7B, after the preparatory rotational operation, a part of outer circumferential surfaces 112*d* of the pair of end part cover portions 112 is exposed and exposed outer circumferential surface 112*d* of end part cover portion 112 and slide contact surface 121*a* of support portion 120 are opposed to each other.

After the preparatory rotational operation, charging roller 110A and photoconductor 10 are in contact with each other along the axial direction of charging roller 110B and a distance between conductive shaft 111 and photoconductor 10 is maintained at a distance in accordance with thickness T2 of the pair of end part cover portions 112 (thickness T2 being equal to thickness T1 of high-resistance coating 113).

Tapered portion 112*a* of each of the pair of end part cover portions 112 is covered with remaining portion 113*e* of high-resistance coating 113, and inner end portion P1 of each of end part cover portions 12 along the axial direction of conductive shaft 111 is maintained as being covered with high-resistance coating 113.

When photoconductor 10 is rotationally driven for formation of an image in this state, outer circumferential surfaces 112*d* of the pair of end part cover portions 112 of charging roller 110B are in slide contact with slide contact surfaces 121*a* of the pair of support portions 120, and end part cover portion 112 is not worn and charging roller 110B smoothly rotates as following rotation of the photoconductor.

As set forth above, after the preparatory rotational operation, such a state that conductive shaft 111 is not exposed in the pair of axial end portions of charging roller 110B but conductive shaft 111 is continuously covered with the pair of end part cover portions 112 and high-resistance coating 113 along the axial direction can be realized and occurrence of leakage in that portion can be suppressed.

Therefore, an effect the same as the effect described in the first embodiment above is obtained also by charger 100B and image forming apparatus 1 including the same in the present embodiment, and a charger which can be reduced in size and can achieve suppression of occurrence of leakage in axial end portions of a charging roller and an image forming apparatus including the same can be obtained.

Third Embodiment

Figure 8A:
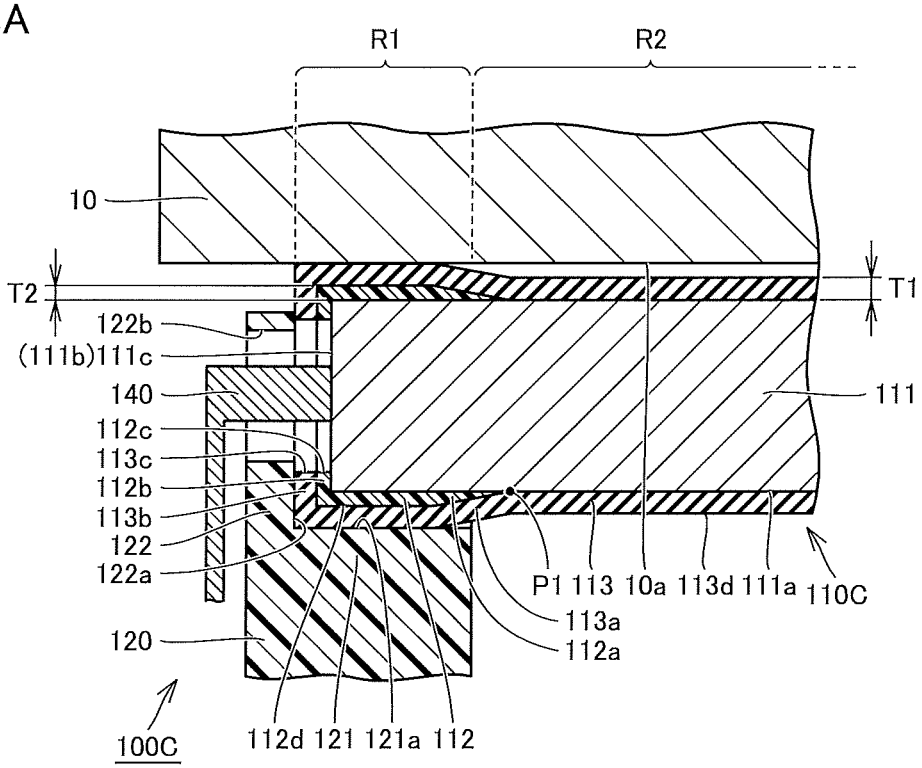
FIGS. 8A and 8B are schematic cross-sectional views showing states of the main portion before and after the preparatory rotational operation while a charger in a third embodiment is attached to the image forming apparatus, respectively.
Figure 8B:
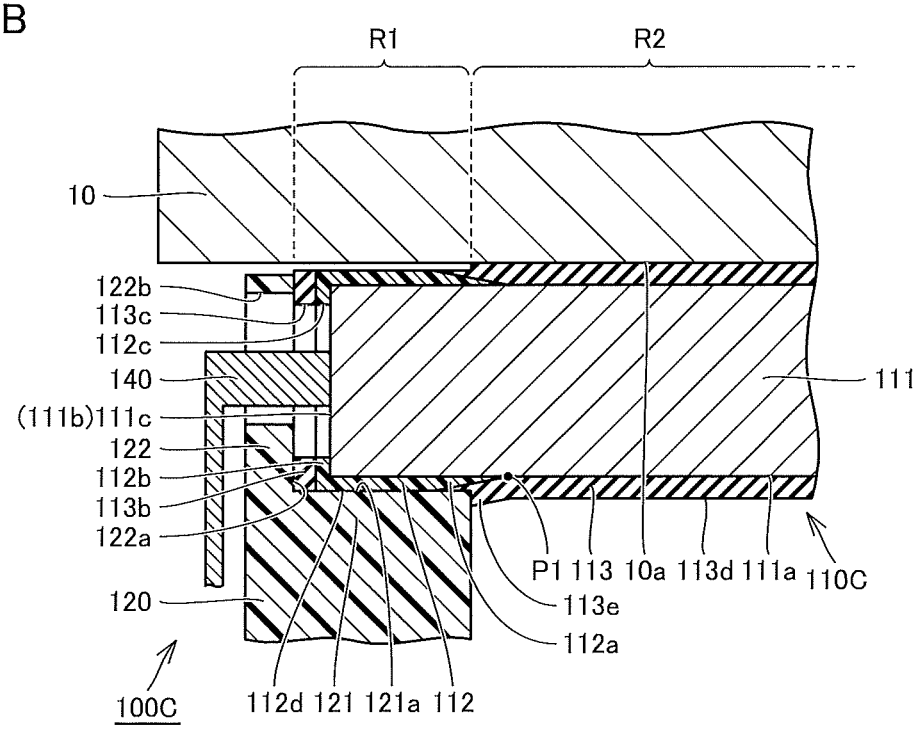

FIGS. 8A and 8B are diagrams showing attachment of a charger in a third embodiment to the image forming apparatus. FIG. 8A is a schematic cross-sectional view showing a state before the preparatory rotational operation of the main portion and FIG. 8B is a schematic cross-sectional view showing a state after the preparatory rotational operation of the main portion. A charger 100C in the present embodiment will be described below with reference to FIGS. 8A and 8B. Charger 100C in the present embodiment is attached to image forming apparatus 1 in the first embodiment described above instead of charger 100A described above.

As shown in FIGS. 8A and 8B, charger 100C in the present embodiment is different from charger 100A in the first embodiment described above only in construction of a charging roller 110C and specifically only in a position where inner end portions P1 of the pair of end part cover portions 112 are disposed.

More specifically, inner end portions P1 of respective end part cover portions 112 are arranged at positions on an inner side along the axial direction of conductive shaft 111 relative to boundary positions between the portions corresponding to the pair of first regions R1 of conductive shaft 111 and the portion corresponding to second region R2 of conductive shaft 111. The pair of end part cover portions 112 is thus arranged not only to reach first region R1 but also to partially reach second region R2 in the axial direction of charging roller 110C.

In this case, as shown in FIG. 8A, before the preparatory rotational operation, charging roller 110C and photoconductor 10 are in contact with each other only in the pair of axial end portions of charging roller 110C and a distance between conductive shaft 111 and photoconductor 10 is maintained at a distance in accordance with the sum of thickness T1 of high-resistance coating 113 and thickness T2 of end part cover portion 112.

As the preparatory rotational operation is performed in this state, high-resistance coating 113 in the portions of charging roller 110C which covers outer circumferential surfaces 112*d* of the pair of end part cover portions 112 is in slide contact with slide contact surfaces 121*a* of the pair of support portions 120 so that high-resistance coating 113 in those portions is worn and outer circumferential surfaces 112*d* of the pair of end part cover portions 112 are partially exposed.

As shown in FIG. 8B, after the preparatory rotational operation, a part of outer circumferential surfaces 112*d* of the pair of end part cover portions 112 is exposed and exposed outer circumferential surface 112*d* of end part cover portion 112 and slide contact surface 121*a* of support portion 120 are opposed to each other.

After the preparatory rotational operation, charging roller 110C and photoconductor 10 are in contact with each other along the axial direction of charging roller 110C and a distance between conductive shaft 111 and photoconductor 10 is maintained at a distance in accordance with thickness T1 of high-resistance coating 113.

Tapered portion 112*a* of each of the pair of end part cover portions 112 is covered with remaining portion 113*e* of high-resistance coating 113 and inner end portion P1 of each of the pair of end part cover portions 112 along the axial direction of conductive shaft 111 is maintained as being covered with high-resistance coating 113.

A portion of remaining portion 113*e* of high-resistance coating 113 which corresponds to second region R2 protrudes outward relative to a portion of high-resistance coating 113 directly covering conductive shaft 111. A size of such a protruding portion, however, is small, and high-resistance coating 113 is made of a member which is relatively likely to elastically deform. Therefore, the protruding portion can readily be collapsed by biasing force applied by the pair of pressing portions 130 and high-resistance coating 113 in the portion covering conductive shaft 111 is in intimate contact with photoconductor 10 in second region R2. Therefore, as described above, a distance between conductive shaft 111 and photoconductor 10 is maintained at a distance in accordance with thickness T1 of high-resistance coating 113.

When photoconductor 10 is rotationally driven for formation of an image in this state, outer circumferential surfaces 112*d* of the pair of end part cover portions 112 in charging roller 110C are in slide contact with slide contact surfaces 121*a* of the pair of support portions 120, and end part cover portion 112 is not worn and charging roller 110C smoothly rotates as following rotation of the photoconductor.

As set forth above, after the preparatory rotational operation, such a state that conductive shaft 111 is not exposed in the pair of axial end portions of charging roller 110C but conductive shaft 111 is continuously covered with the pair of end part cover portions 112 and high-resistance coating 113 along the axial direction can be realized and occurrence of leakage in that portion can be suppressed.

Therefore, an effect the same as the effect described in the first embodiment above is obtained also by charger 100C and image forming apparatus 1 including the same in the present embodiment, and a charger which can be reduced in size and can achieve suppression of occurrence of leakage in axial end portions of a charging roller and an image forming apparatus including the same can be obtained.

Fourth Embodiment

Figure 9A:
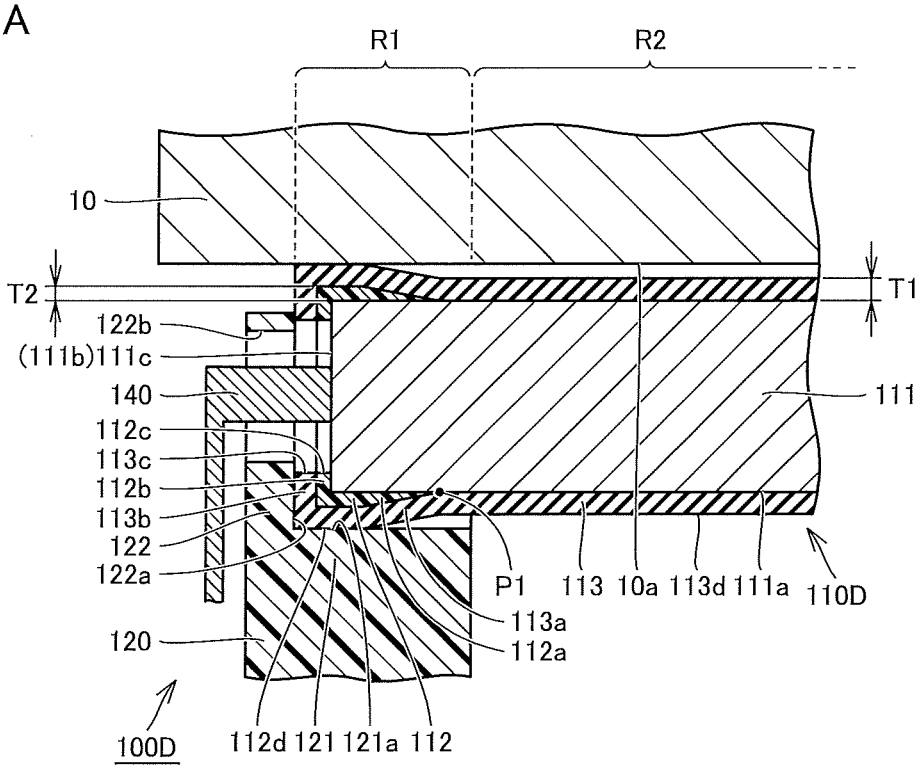
FIGS. 9A and 9B are schematic cross-sectional views showing states of the main portion before and after the preparatory rotational operation while a charger in a fourth embodiment is attached to the image forming apparatus, respectively.
Figure 9B:
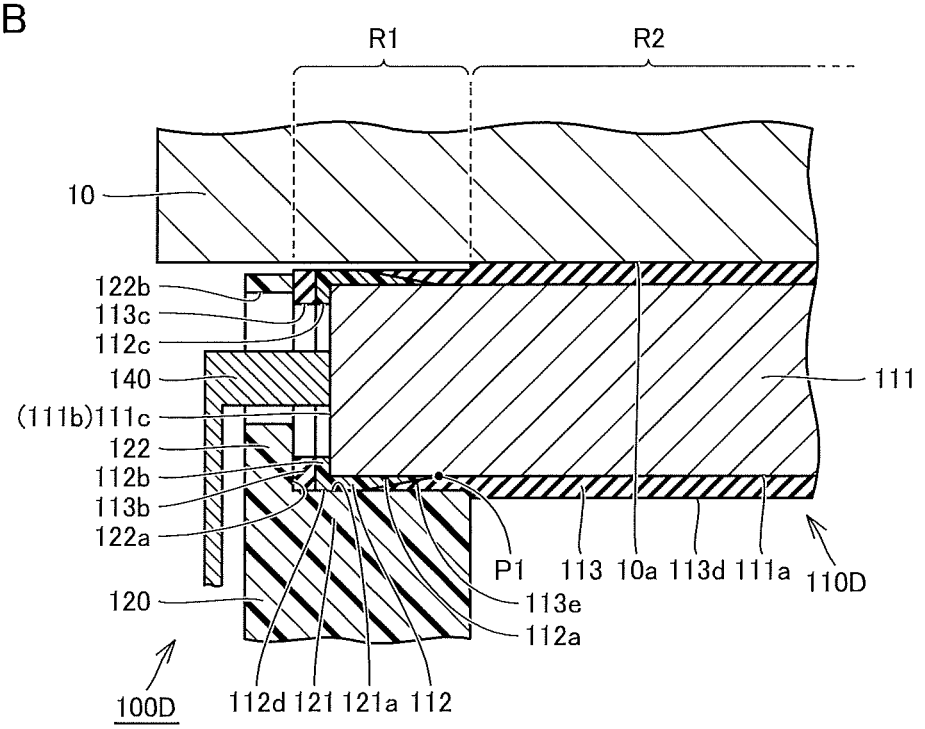

FIGS. 9A and 9B are diagrams showing attachment of a charger in a fourth embodiment to the image forming apparatus. FIG. 9A is a schematic cross-sectional view showing a state before the preparatory rotational operation of the main portion and FIG. 9B is a schematic cross-sectional view showing a state after the preparatory rotational operation of the main portion. A charger 100D in the present embodiment will be described below with reference to FIGS. 9A and 9B. Charger 100D in the present embodiment is attached to image forming apparatus 1 in the first embodiment described above instead of charger 100A described above.

As shown in FIGS. 9A and 9B, charger 100D in the present embodiment is different from charger 100A in the first embodiment described above only in construction of a charging roller 110D and specifically in positions where inner end portions P1 of the pair of end part cover portions 112 are disposed.

More specifically, inner end portions P1 of respective end part cover portions 112 are arranged at positions on an outer side along the axial direction of conductive shaft 111 relative to boundary positions between the portions corresponding to the pair of first regions R1 of conductive shaft 111 and the portion corresponding to second region R2 of conductive shaft 111. The pair of end part cover portions 112 is thus arranged only in first regions R1 in the axial direction of charging roller 110D.

In this case, as shown in FIG. 9A, before the preparatory rotational operation, charging roller 110D and photoconductor 10 are in contact with each other only in the pair of axial end portions of charging roller 110D and a distance between conductive shaft 111 and photoconductor 10 is maintained at a distance in accordance with the sum of thickness T1 of high-resistance coating 113 and thickness T2 of end part cover portion 112.

As the preparatory rotational operation is performed in this state, high-resistance coating 113 in the portions of charging roller 110D which covers outer circumferential surfaces 112*d* of the pair of end part cover portions 112 is in slide contact with slide contact surfaces 121*a* of the pair of support portions 120 so that high-resistance coating 113 in those portions are worn and outer circumferential surfaces 112*d* of the pair of end part cover portions 112 are partially exposed.

As shown in FIG. 9B, after the preparatory rotational operation, a part of outer circumferential surfaces 112*d* of the pair of end part cover portions 112 is exposed and exposed outer circumferential surface 112*d* of end part cover portion 112 and slide contact surface 121*a* of support portion 120 are opposed to each other.

After the preparatory rotational operation, charging roller 110D and photoconductor 10 are in contact with each other along the axial direction of charging roller 110D and a distance between conductive shaft 111 and photoconductor 10 is maintained at a distance in accordance with thickness T1 of high-resistance coating 113.

Tapered portion 112*a* of each of the pair of end part cover portions 112 is covered with remaining portion 113*e* of high-resistance coating 113 and inner end portion P1 of each of the pair of end part cover portions 112 along the axial direction of conductive shaft 111 is maintained as being covered with high-resistance coating 113.

When photoconductor 10 is rotationally driven for formation of an image in this state, outer circumferential surfaces 112*d* of the pair of end part cover portions 112 in charging roller 110D are in slide contact with slide contact surfaces 121*a* of the pair of support portions 120, and end part cover portion 112 is not worn and charging roller 110D smoothly rotates as following rotation of the photoconductor.

As set forth above, after the preparatory rotational operation, such a state that conductive shaft 111 is not exposed in the pair of axial end portions of charging roller 110D but conductive shaft 111 is continuously covered with the pair of end part cover portions 112 and high-resistance coating 113 along the axial direction can be realized and occurrence of leakage in that portion can be suppressed.

Therefore, an effect the same as the effect described in the first embodiment above is obtained also by charger 100D and image forming apparatus 1 including the same in the present embodiment, and a charger which can be reduced in size and can achieve suppression of occurrence of leakage in axial end portions of a charging roller and an image forming apparatus including the same can be obtained.

Fifth Embodiment

Figure 10A:
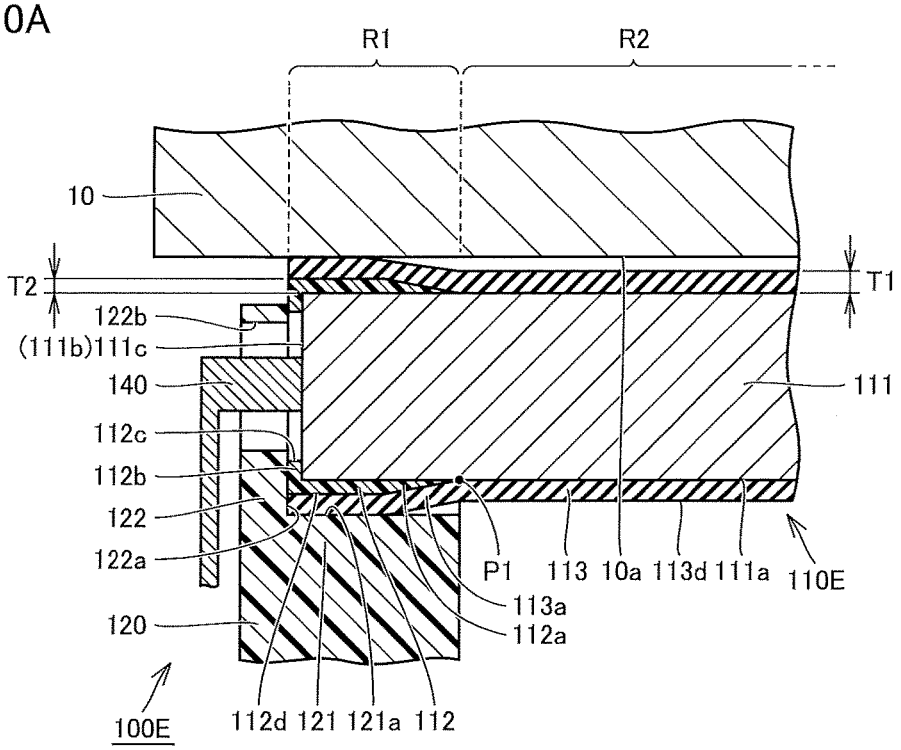
FIGS. 10A and 10B are schematic cross-sectional views showing states of the main portion before and after the preparatory rotational operation while a charger in a fifth embodiment is attached to the image forming apparatus, respectively.
Figure 10B:
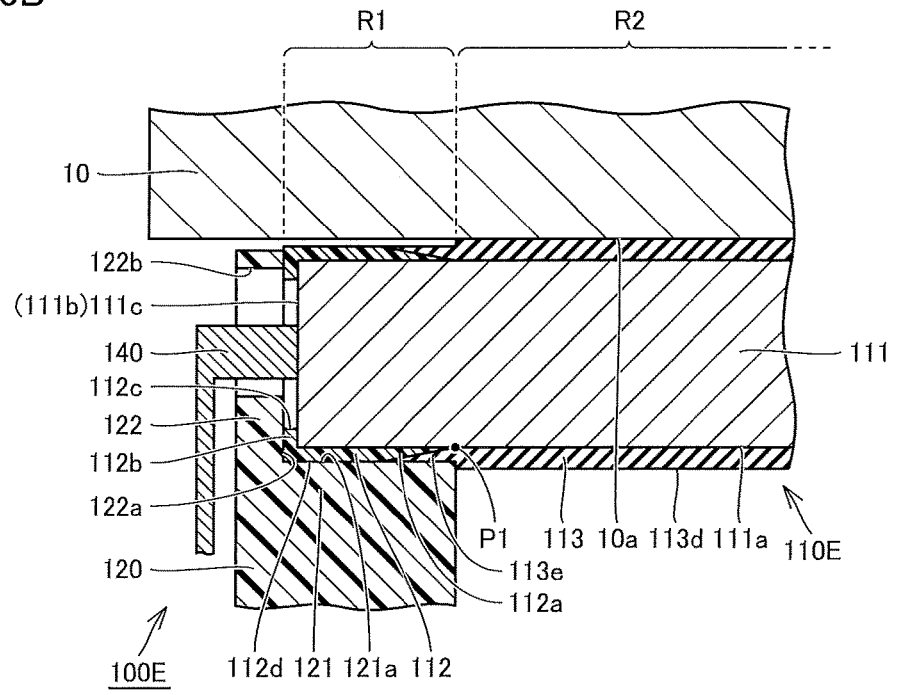

FIGS. 10A and 10B are diagrams showing attachment of a charger in a fifth embodiment to the image forming apparatus. FIG. 10A is a schematic cross-sectional view showing a state before the preparatory rotational operation of the main portion and FIG. 10B is a schematic cross-sectional view showing a state after the preparatory rotational operation of the main portion. A charger 100E in the present embodiment will be described below with reference to FIGS. 10A and 10B. Charger 100E in the present embodiment is attached to image forming apparatus 1 in the first embodiment described above instead of charger 100A described above.

As shown in FIGS. 10A and 10B, charger 100E in the present embodiment is different from charger 100A in the first embodiment described above only in construction of a charging roller 110E and specifically only in shape of opposing end portions of high-resistance coating 113.

More specifically, high-resistance coating 113 does not have portions covering the pair of axial end surfaces 111*b* of conductive shaft 111 but is discontinuous at a portion corresponding to outer end P2 of conductive shaft 111 (see FIG. 4). High-resistance coating 113 covers only outer circumferential surfaces 112*d* of the pair of end part cover portions 112 and does not cover extension portions 112*b* of the pair of end part cover portions 112. The pair of axial end surfaces 111*b* of conductive shaft 111 thus has outer circumferential edges covered only with extension portions 112*b* of the pair of end part cover portions 112.

According to such a feature as well, as shown in FIG. 10B, after the preparatory rotational operation, such a state that conductive shaft 111 is not exposed in the pair of axial end portions of charging roller 110E but conductive shaft 111 is continuously covered with the pair of end part cover portions 112 and high-resistance coating 113 along the axial direction can be realized and occurrence of leakage in that portion can be suppressed.

Since the pair of axial end surfaces of conductive shaft 111 also has the outer circumferential edges covered with extension portions 112*b* of the pair of end part cover portions 112, a creepage distance between photoconductor 10 and conductive shaft 111 can be ensured and occurrence of leakage also in that portion can be suppressed.

Therefore, an effect the same as the effect described in the first embodiment above is obtained also by charger 100E and image forming apparatus 1 including the same in the present embodiment, and a charger which can be reduced in size and can achieve suppression of occurrence of leakage in axial end portions of a charging roller and an image forming apparatus including the sane can be obtained.

Sixth Embodiment

Figure 11A:
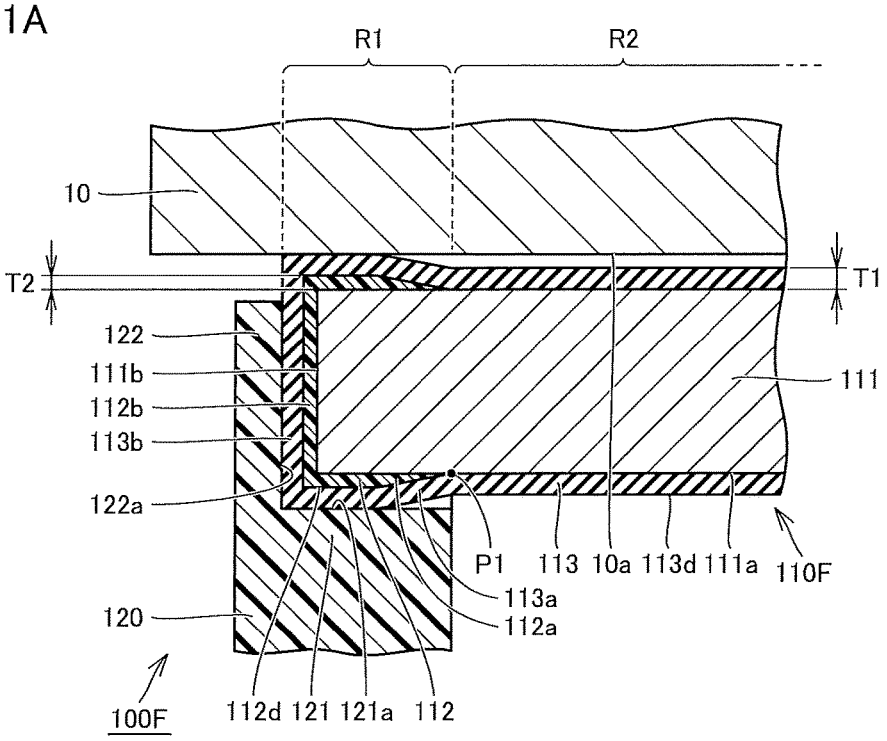
FIGS. 11A and 11B are schematic cross-sectional views showing states of the main portion before and after the preparatory rotational operation while a charger in a sixth embodiment is attached to the image forming apparatus, respectively.
Figure 11B:
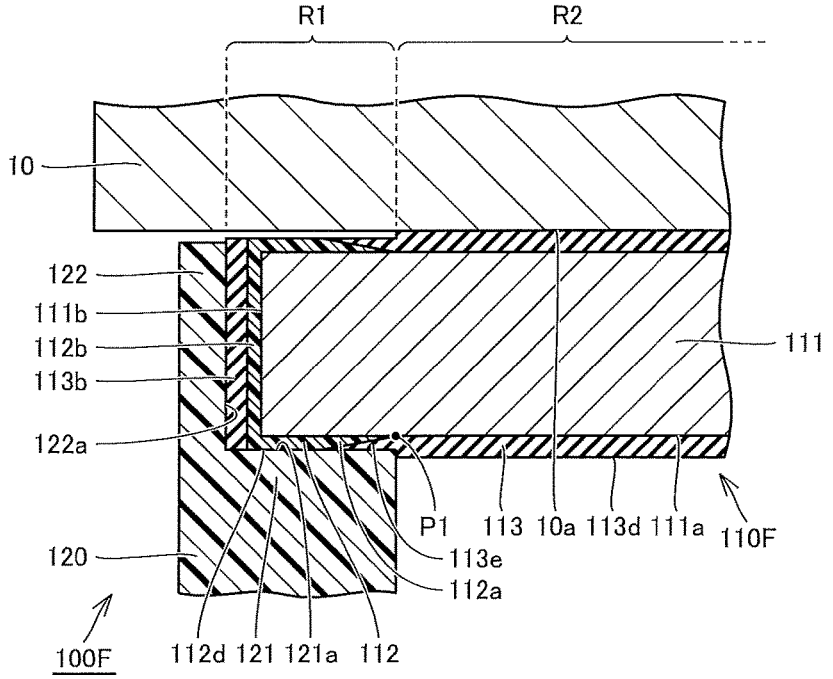

FIGS. 11A and 11B are diagrams showing attachment of a charger in a sixth embodiment to the image forming apparatus. FIG. 11A is a schematic cross-sectional view showing a state before the preparatory rotational operation of the main portion and FIG. 11B is a schematic cross-sectional view showing a state after the preparatory rotational operation of the main portion. A charger 100F in the present embodiment will be described below with reference to FIGS. 11A and 11B. Charger 100F in the present embodiment is attached to image forming apparatus 1 in the first embodiment described above instead of charger 100A described above.

As shown in FIGS. 11A and 11B, charger 100F in the present embodiment is different from charger 100A in the first embodiment described above basically in construction of a charging roller 110F and specifically in shape of one axial end portion of charging roller 110F.

More specifically, in one axial end portion of charging roller 110F shown in FIGS. 11A and 11B, axial end surface 111*b* of conductive shaft 111 is covered with extension portion 112*b* of end part cover portion 112 and extension portion 113*b* of high-resistance coating 113 not only at the outer circumferential edge thereof but also over the entire surface including the outer circumferential edge. Accordingly, charger 100F is not provided with contact point 140 (see FIG. 3) at a position on a side of one axial end portion of charging roller 110F.

Though not shown, in the other axial end portion of charging roller 110F, exposed region 111*c* is provided in the other axial end surface of conductive shaft 111 as in the first embodiment described above, and contact point 140 is provided as being in contact with exposed region 111*c*.

This is because a charging bias does not necessarily have to be applied to conductive shaft 111 by providing contact points 140 at axial opposing ends but it should be applied only at least to axial one end.

According to such a construction as well, as shown in FIG. 11B, after the preparatory rotational operation, such a state that conductive shaft 111 is not exposed in the pair of axial end portions of charging roller 110F but conductive shaft 111 is continuously covered with the pair of end part cover portions 112 and high-resistance coating 113 along the axial direction can be realized and occurrence of leakage in that portion can be suppressed.

Furthermore, since the entire surface of one of the pair of axial end surfaces of conductive shaft 111 is covered with extension portion 112*b* of end part cover portion 112 and extension portion 113*b* of high-resistance coating 113, occurrence of leakage in that portion can be suppressed. In addition, since the other of the pair of axial end surfaces of conductive shaft 111 has the outer circumferential edge covered with extension portion 112*b* of end part cover portion 112 and extension portion 113*b* of high-resistance coating 113, a creepage distance between photoconductor 10 and conductive shaft 111 can be ensured and occurrence of leakage also in that portion can be suppressed.

Therefore, an effect the same as the effect described in the first embodiment above is obtained also by charger 100F and image forming apparatus 1 including the same in the present embodiment, and a charger which can be reduced in size and can achieve suppression of occurrence of leakage in axial end portions of a charging roller and an image forming apparatus including the same can be obtained.

Seventh Embodiment

Figure 12A:
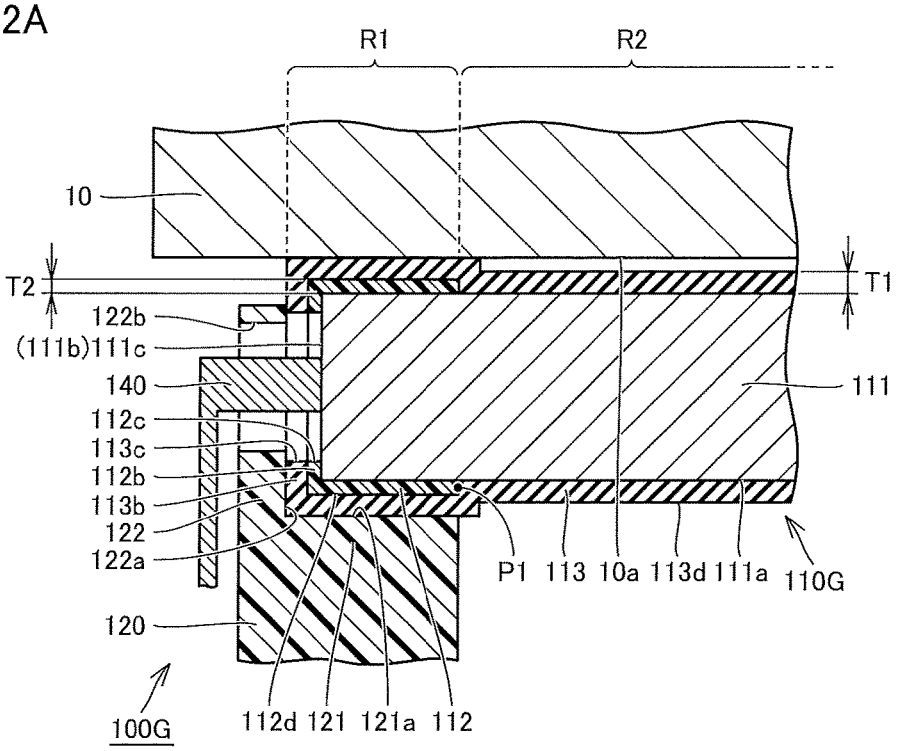
FIGS. 12A and 12B are schematic cross-sectional views showing states of the main portion before and after the preparatory rotational operation while a charger in a seventh embodiment is attached to the image forming apparatus, respectively.
Figure 12B:
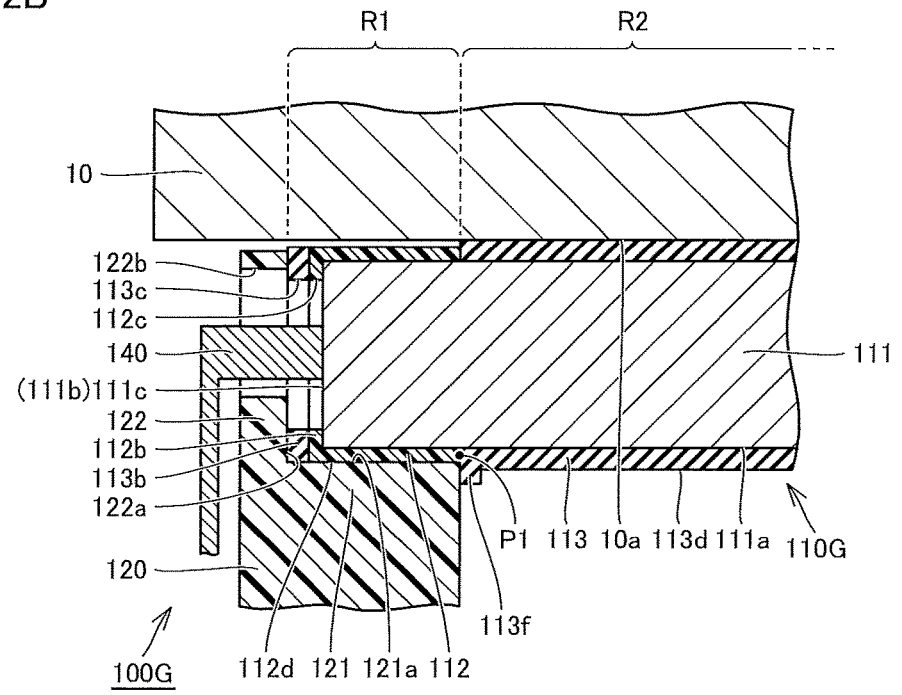

FIGS. 12A and 12B are diagrams showing attachment of a charger in a seventh embodiment to the image forming apparatus. FIG. 12A is a schematic cross-sectional view showing a state before the preparatory rotational operation of the main portion and FIG. 12B is a schematic cross-sectional view showing a state after the preparatory rotational operation of the main portion. A charger 100G in the present embodiment will be described below with reference to FIGS. 12A and 12B. Charger 100G in the present embodiment is attached to image forming apparatus 1 in the first embodiment described above instead of charger 100A described above.

As shown in FIGS. 12A and 12B, charger 100G in the present embodiment is different from charger 100A in the first embodiment described above only in construction of a charging roller 110G and specifically only in shape of the pair of end part cover portions 112.

More specifically, unlike charging roller 110A shown in FIGS. 5A and 5B, the pair of end part cover portions 112 does not have tapered portions 112*a* but is constructed to have uniform thickness T2 from inner end portion P1 to a portion covering outer end P2 of conductive shaft 111 along the axial direction of conductive shaft 111.

In this case, as shown in FIG. 12A, before the preparatory rotational operation, charging roller 110G and photoconductor 10 are in contact with each other only in the pair of axial end portions of charging roller 110G and a distance between conductive shaft 111 and photoconductor 10 is maintained at a distance in accordance with the sum of thickness T1 of high-resistance coating 113 and thickness T2 of end part cover portion 112.

As the preparatory rotational operation is performed in this state, high-resistance coating 113 in the portions of charging roller 110G covering outer circumferential surfaces 112*d* of the pair of end part cover portions 112 is in slide contact with slide contact surfaces 121*a* of the pair of support portions 120, and high-resistance coating 113 in those portions are worn and outer circumferential surfaces 112*d* of the pair of end part cover portions 112 are exposed.

As shown in FIG. 12B, after the preparatory rotational operation, outer circumferential surface 112*d* of each of the pair of end part cover portions 112 is exposed and exposed outer circumferential surface 112*d* of end part cover portion 112 and slide contact surface 121*a* of support portion 120 are opposed to each other.

After the preparatory rotational operation, charging roller 110G and photoconductor 10 are in contact with each other along the axial direction of charging roller 110G, and a distance between conductive shaft 111 and photoconductor 10 is maintained at a distance in accordance with thickness T1 of high-resistance coating 113.

Inner end portion P1 of each of the pair of end part cover portions 112 along the axial direction of conductive shaft 111 is maintained as being covered with high-resistance coating 113.

A protruding portion 113*f* which protrudes outward remains in the portion corresponding to second region R2, of the portion of high-resistance coating 113 adjacent to first region R1. A size of protruding portion 113*f*, however, is small, and high-resistance coating 113 is made of a member which is relatively likely to elastically deform. Therefore, protruding portion 113*f* can readily be collapsed by biasing force applied by the pair of pressing portions 130 and high-resistance coating 113 in the portion covering conductive shaft 111 is in intimate contact with photoconductor 10 in second region R2. Therefore, as described above, a distance between conductive shaft 111 and photoconductor 10 is maintained at a distance in accordance with thickness T1 of high-resistance coating 113.

When photoconductor 10 is rotationally driven for formation of an image in this state, outer circumferential surfaces 112*d* of the pair of end part cover portions 112 in charging roller 110G are in slide contact with slide contact surfaces 121*a* of the pair of support portions 120, and end part cover portion 112 is not worn and charging roller 110G smoothly rotates as following rotation of the photoconductor.

As set forth above, after the preparatory rotational operation, such a state that conductive shaft 111 is not exposed in the pair of axial end portions of charging roller 110G but conductive shaft 111 is continuously covered with the pair of end part cover portions 112 and high-resistance coating 113 along the axial direction can be realized and occurrence of leakage in that portion can be suppressed.

Therefore, an effect the same as the effect described in the first embodiment above is obtained also by charger 100G and image forming apparatus 1 including the same in the present embodiment, and a charger which can be reduced in size and can achieve suppression of occurrence of leakage in axial end portions of a charging roller and an image forming apparatus including the same can be obtained.

<First Verification Test>

In a first verification test, various samples 1 to 6 different in material or surface roughness were prepared as the end part cover portions shown in the first to seventh embodiments described above, a coefficient of friction against nonwoven fabric was measured by bringing each of samples 1 to 6 into contact with the nonwoven fabric, and whether or not followability of the charging roller could be ensured with each of samples 1 to 6 being actually incorporated in the charger was checked.

A coefficient of friction against nonwoven fabric was measured with a portable friction meter (TYPE-94) manufactured by Shinto Scientific Co., Ltd. Specifically, a coefficient of friction against nonwoven fabric of each sample was measured by bonding the nonwoven fabric to a probe portion of the friction meter and bringing each of samples 1 to 6 into contact with the bonded nonwoven fabric.

Followability of the charging roller was checked by using an image forming apparatus (bizhub C287) manufactured by Konica Minolta, Inc., installing a controller by improving a charger thereof, setting an abutment pressure applied to a photoconductor to 30 [N/m], and setting the charging roller incorporating each sample in the charger.

In determining followability, the charging roller was visually checked. Since noise streaks are produced in an image formed on paper when followability of the charging roller is lowered, followability was checked also based on presence of noise. Results were evaluated as "excellent" when followability could visually be recognized and no noise was produced in an image, as "good" when followability could not visually be recognized but no noise was produced in an image, and as "poor" when followability could not visually be recognized and noise was produced in an image.

FIG. 13 shows a table showing results of the first verification test. As shown in FIG. 13, it could be confirmed that no noise was produced in the image when a coefficient of friction against the nonwoven fabric of the pair of end part cover portions was not higher than 0.33, and it could further be confirmed that followability of the charging roller could be ensured when a coefficient of friction against the nonwoven fabric of the pair of end part cover portions was not higher than 0.29.

It could be confirmed based on the results that at least no noise was produced in an image when the coefficient of friction against the nonwoven fabric of the pair of end part cover portions was higher than 0.29 and not higher than 0.33. From a point of view of reliably ensuring followability of the charging roller, it can be concluded that the coefficient of friction against nonwoven fabric of the pair of end part cover portions was preferably not higher than 0.29.

<Second Verification Test>

In a second verification test, the charger in the first embodiment described above was actually prototyped and attached to an image forming apparatus (an image forming apparatus (bizhub C287) manufactured by Konica Minolta, Inc.), and whether or not an unfavorable condition due to leakage was caused was checked.

Specifically, a charging roller was manufactured such that a high-resistance coating of a charging roller had a thickness of 15 [μm] and a roller resistance (Log Ω) of the charging roller at the time of application of 200 [V] was not lower than 4.5 and not higher than 6.0. The charger including the charging roller was attached to the image forming apparatus, a bias resulting from superimposition of an AC bias on a DC bias was supplied at a voltage of 2 [kV] at the maximum to the charging roller, discharge from an axial end portion of the charging roller to the photoconductor was visually checked, and inflow of a leakage current to the photoconductor and quality of an image were checked.

Consequently, it was confirmed that there was no discharge from the axial end portion of the charging roller to the photoconductor, there was no inflow of the leakage current to the photoconductor either, and quality of the image was also good. Therefore, it can be concluded that reduction in size and effective suppression of occurrence of leakage in the axial end portion of the charging roller were also experimentally confirmed in the charger and the image forming apparatus including the same in the embodiment described above.

(Other Forms)

Characteristic features shown in the first to seventh embodiments described above can naturally be combined with one another without departing from the gist of the present invention.

Though description has been given in the first to seventh embodiments above by referring to application of the present invention to what is called a tandem type color printer adapted to electrophotography and a charger included therein by way of example, applications of the present invention are not limited thereto but the present invention is applicable to various chargers and image forming apparatuses including the same.

Although embodiments of the present invention have been described and illustrated in detail, the disclosed embodiments are made for purposes of illustration and example only and not limitation. The scope of the present invention should be interpreted by terms of the appended claims.

What is claimed is:

1. A charger comprising:

a charging roller;

a pair of support portions which rotationally supports the charging roller by supporting a pair of axial end portions of the charging roller; and a pair of pressing portions which presses the charging roller toward a charged object by biasing the pair of support portions, the charging roller including a pair of first regions which is opposed to the pair of support portions in a radial direction and a second region located between the pair of first regions in an axial direction, the charging roller including a substantially columnar conductive shaft located across the pair of first regions and the second region, a pair of end part cover portions which is in contact with and covers at least a part of outer circumferential surfaces of portions of the conductive shaft corresponding to the pair of first regions and is in slide contact with the pair of support portions, and a high-resistance coating which is in contact with and covers at least a part of an outer circumferential surface of a portion of the conductive shaft corresponding to the second region and abuts on an outer circumferential surface of a charged object to charge the charged object, an inner end portion of each of the pair of end part cover portions along the axial direction of the conductive shaft being covered with the high-resistance coating, and a thickness of the high-resistance coating in a portion which is in contact with and covers an outer circumferential surface of the conductive shaft being equal to or greater than a thickness of the pair of end part cover portions in portions which are in contact with and cover the outer circumferential surface of the conductive shaft.

2. The charger according to claim 1, wherein the pair of end part cover portions has a volume resistivity not lower than $10^{11}$[Ω·cm].

3. The charger according to claim 1, wherein the pair of end part cover portions has a Mohs hardness not lower than 2 and not higher than 4.

4. The charger according to claim 1, wherein the pair of end part cover portions has a coefficient of friction against nonwoven fabric not higher than 0.29.

5. The charger according to claim 1, wherein a portion of each of the pair of end part cover portions closer to the inner end portion is in an inclined shape gradually decreasing in thickness toward a central portion in the axial direction of the conductive shaft.

6. The charger according to claim 5, wherein the portion of each of the pair of end part cover portions in the inclined shape is covered with the high-resistance coating.

7. The charger according to claim 1, wherein the inner end portion of each of the pair of end part cover portions is arranged in alignment with each of boundary positions between the portions of the conductive shaft corresponding to the pair of first regions and the portion of the conductive shaft corresponding to the second region or arranged at a position on an inner side relative to each boundary position along the axial direction of the conductive shaft.

8. The charger according to claim 1, wherein each of the pair of end part cover portions extends to reach an outer end in the axial direction of the conductive shaft from the inner end portion.

9. The charger according to claim 8, wherein each of the pair of end part cover portions covers at least an outer circumferential edge portion of an axial end surface of the conductive shaft.

10. The charger according to claim 1, the charger further comprising a contact point for supplying a voltage to the conductive shaft, wherein an exposed region where the conductive shaft is exposed without being covered with one corresponding end part cover portion of the pair of end part cover portions is provided in one axial end surface of the charging roller, and the contact point is in contact with the conductive shaft in the exposed region.

11. The charger according to claim 1, wherein each of the pair of end part cover portions is made of a heat shrinkable member.

12. The charger according to claim 1, wherein each of the pair of support portions has a base portion which defines a slide contact surface which is in slide contact with an outer circumferential surface of an axial end portion of the charging roller, and the slide contact surface is provided with a groove which extends in a direction oblique to the axial direction of the charging roller.

13. The charger according to claim 12, wherein each of the pair of support portions further has an end wall portion which is opposed to an axial end surface of the charging roller and defines a closing surface continuous to the slide contact surface, and the groove is constructed such that, of one end portion and the other end portion located in a direction of extension of the groove, the one end portion which is an end portion located on a side of the end wall portion is located upstream from the other end portion in a direction of rotation of the charging roller.

14. The charger according to claim 12, wherein a space defined by the slide contact surface of the base portion is opened by providing a cut in a portion of the base portion arranged on a side of the charged object, and an end surface located downstream in a direction of rotation of the charging roller of a pair of end surfaces of the base portion arranged on the side of the charged object is retracted as being arranged farther from the charged object than an end surface located upstream in the direction of rotation of the charging roller.

15. An image forming apparatus comprising:

a photoconductor as a charged object; and the charger according to claim 1.

16. An image forming apparatus comprising the charger according to claim 1, the charger including the charging roller after preparatory rotational operation, by being configured such that the preparatory rotational operation is performed upon detecting implementation of the charger before formation of an image.

* * * * *